US009192842B2

(12) United States Patent
Alger

(10) Patent No.: US 9,192,842 B2
(45) **Date of Patent: *Nov. 24, 2015**

(54) SOCCER BALL DELIVERY SYSTEM AND METHOD

(71) Applicant: Seattle Sport Sciences, Inc., Redmond, WA (US)

(72) Inventor: Jeffrey H. Alger, Redmond, WA (US)

(73) Assignee: Seattle Sport Sciences, Inc., Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/047,511

(22) Filed: Oct. 7, 2013

(65) Prior Publication Data

US 2014/0121038 A1 May 1, 2014

Related U.S. Application Data

(63) Continuation of application No. 13/728,507, filed on Dec. 27, 2012, now Pat. No. 8,550,063, which is a continuation of application No. 13/021,527, filed on Feb. 4, 2011, now Pat. No. 8,342,162, which is a continuation of application No. 11/833,124, filed on Aug. 2, 2007, now Pat. No. 7,882,831.

(60) Provisional application No. 60/834,883, filed on Aug. 2, 2006.

(51) Int. Cl.

| | |
|---|---|
| ***F41B 4/00*** | (2006.01) |
| ***A63B 69/40*** | (2006.01) |
| ***A63B 69/00*** | (2006.01) |

(52) U.S. Cl.

CPC ..... *A63B 69/406* (2013.01); *A63B 69/002* (2013.01); *A63B 2069/402* (2013.01); *A63B 2243/0025* (2013.01)

(58) Field of Classification Search

CPC ..... A63B 69/40; A63B 69/406

See application file for complete search history.

(56) References Cited

U.S. PATENT DOCUMENTS

| | | | |
|---|---|---|---|
| 3,306,613 | A | 2/1967 | Mainers |
| 3,777,732 | A | 12/1973 | Holloway et al. |
| 4,197,827 | A | 4/1980 | Smith |
| 4,442,823 | A | 4/1984 | Floyd et al. |

(Continued)

FOREIGN PATENT DOCUMENTS

| | | | |
|---|---|---|---|
| EP | 0 815 904 | A2 | 1/1998 |
| WO | 2004/094004 | A2 | 11/2004 |

*Primary Examiner* — John Ricci

(74) *Attorney, Agent, or Firm* — Seed IP Law Group PLLC

(57) ABSTRACT

A system for delivering objects, such as soccer balls, the system including a delivery device and a methodology for training individuals that can be used with the delivery device, the delivery device including an accelerator that accepts, accelerates, and launches the balls with motion characteristics, and a control system having an electronic controller structured to store and execute a training program that includes ball service specifications and player service variables, ball speed and spin control inputs, and random selection of values within a range of values of the player service variables that include a starting position of the player relative to the device, a direction of motion of the player relative to the device, an identification of at least one location on the player's body to touch the ball, a time interval to wait before delivering the ball, and an action for the user to take with the ball.

7 Claims, 31 Drawing Sheets

(56) References Cited

U.S. PATENT DOCUMENTS

| | | | | |
|---|---|---|---|---|
| 4,714,248 | A | 12/1987 | Koss | |
| 4,841,945 | A | 6/1989 | Braden | |
| 5,056,782 | A | 10/1991 | Giovagnoli | |
| 5,125,653 | A | 6/1992 | Kovács et al. | |
| 5,464,208 | A | 11/1995 | Pierce | |
| 5,733,209 | A | 3/1998 | McIntyre, IV | |
| 5,897,445 | A | 4/1999 | Sanders et al. | |
| 5,911,214 | A | 6/1999 | Andrews | |
| 6,237,583 | B1 | 5/2001 | Ripley et al. | |
| 6,440,013 | B1 | 8/2002 | Brown | |
| 6,470,873 | B2 | 10/2002 | Battersby et al. | |
| 6,488,020 | B1 | 12/2002 | Rosas-Magallan | |
| 6,513,512 | B2 | 2/2003 | Battersby et al. | |
| 6,863,059 | B1 | 3/2005 | Lee | |
| 6,880,542 | B1 | 4/2005 | Johndreau et al. | |
| 7,082,938 | B2 | 8/2006 | Wilmot | |
| 7,882,831 | B2 | 2/2011 | Alger | |
| 8,342,162 | B2 * | 1/2013 | Alger | 124/78 |
| 8,550,063 | B2 * | 10/2013 | Alger | 124/78 |
| 2001/0006063 | A1 | 7/2001 | Battersby et al. | |
| 2002/0148455 | A1 | 10/2002 | Trajkovic et al. | |

* cited by examiner

Stored Training Program

Service Set

| ID | Speed | | Spin | | Yaw | | Elevation | | Roll | |
|---|---|---|---|---|---|---|---|---|---|---|
| | Min | Max | Min | Max | Min | Max | Min | Max | Min | Max |
| 1 | 13 | 17 | -2 | -2 | -3 | 3 | 5 | 5 | 0 | 0 |
| 2 | 13 | 17 | -2 | -2 | -3 | 3 | 10 | 10 | 0 | 0 |
| 3 | 13 | 17 | -2 | -2 | -3 | 3 | 15 | 15 | 0 | 0 |
| 4 | 13 | 17 | -2 | -2 | -3 | 3 | 20 | 20 | 0 | 0 |
| 5 | 13 | 17 | -2 | -2 | -3 | 3 | 25 | 25 | 0 | 0 |
| 6 | 18 | 22 | -2 | -2 | -3 | 3 | 5 | 5 | 0 | 0 |
| 7 | 18 | 22 | -2 | -2 | -3 | 3 | 10 | 10 | 0 | 0 |
| 8 | 18 | 22 | -2 | -2 | -3 | 3 | 15 | 15 | 0 | 0 |
| 9 | 18 | 22 | -2 | -2 | -3 | 3 | 20 | 20 | 0 | 0 |
| 10 | 18 | 22 | -2 | -2 | -3 | 3 | 25 | 25 | 0 | 0 |

Instruction Sequence

| Instruction # | Service ID | Wait Time |
|---|---|---|
| 1 | 1 | - |
| 2 | - | 10 |
| 3 | 3 | - |
| 4 | - | 10 |
| 5 | 5 | - |
| 6 | - | 10 |
| 7 | 1, 3, 5 | - |
| 8 | - | 10 |
| 9 | 1, 3, 5 | - |
| 10 | - | 10 |
| 11 | 1, 3, 5 | - |
| 12 | - | 10 |
| 13 | 1, 3, 5 | - |

*FIG. 26*

156 158 160 162

First Touch Training Skill Set

| Skill ID | Service Variables | | | | | | Player Variables | | | | |
|---|---|---|---|---|---|---|---|---|---|---|---|
| | Location of Service | Ball Speed | Spin | Yaw | Elevation | Roll | Start Angle | Start Distance | Angle of Motion | Body Surface | Target Zone |
| 1 | (0,0) | 10 | -2 | 0 | 15 | 0 | 30 | 20 | 30 | Left instep | Upper right |
| 2 | (0,0) | 15 | -2 | 0 | 15 | 0 | 30 | 20 | 30 | Left instep | Upper right |
| 3 | (0,0) | 20 | -2 | 0 | 15 | 0 | 30 | 20 | 30 | Left instep | Upper right |
| 4 | (0,0) | 25 | -2 | 0 | 15 | 0 | 30 | 20 | 30 | Left instep | Upper right |

FIG. 27

Training Skill Set

| 1-Touch | | | | | | | | | | | |
|---|---|---|---|---|---|---|---|---|---|---|---|
| Skill ID | Service Variables | | | | | | Player Variables | | | | |
| | Location of | Ball | Spin | Yaw | Elevation | Roll | Start | Start | Angle of | Body | Target |
| 1 | (0,0) | 10 | -2 | 0 | 15 | 0 | 30 | 20 | 30 | Left instep | Upper right |
| 2 | (0,0) | 15 | -2 | 0 | 15 | 0 | 30 | 20 | 30 | Left instep | Upper right |
| 3 | (0,0) | 20 | -2 | 0 | 15 | 0 | 30 | 20 | 30 | Left instep | Upper right |
| 4 | (0,0) | 25 | -2 | 0 | 15 | 0 | 30 | 20 | 30 | Left instep | Upper right |

| 2-Touch | | | | | | | | | | | | |
|---|---|---|---|---|---|---|---|---|---|---|---|---|
| Skill ID | Service Variables | | | | | | Player Variables | | | | | |
| | | | | | | | | | | Body Surface | | |
| | Location of Service | Ball Speed | Spin | Yaw | Elevation | Roll | Start Angle | Start Distance | Angle of Motion | 1st Touch | 2nd Touch | Target Zone |
| 101 | (0,0) | 10 | -2 | 0 | 15 | 0 | 30 | 20 | 30 | Chest | Left instep | Upper right |
| 102 | (0,0) | 15 | -2 | 0 | 15 | 0 | 30 | 20 | 30 | Chest | Left instep | Upper right |
| 103 | (0,0) | 20 | -2 | 0 | 15 | 0 | 30 | 20 | 30 | Chest | Left instep | Upper right |
| 104 | (0,0) | 25 | -2 | 0 | 15 | 0 | 30 | 20 | 30 | Chest | Left instep | Upper right |

*FIG. 28*

Training Curriculum

| Skill ID | Training Level |
|---|---|
| 1 | 1 |
| 2 | 1 |
| 3 | 1 |
| 4 | 2 |
| 101 | 3 |
| 102 | 3 |
| 103 | 4 |
| 104 | 4 |

*FIG. 29*

SOCCER BALL DELIVERY SYSTEM AND METHOD

BACKGROUND

1. Technical Field

The present disclosure pertains to systems, devices, and methods directed to the delivery or service of objects and, in a representative embodiment, to a soccer ball delivery system and devices for highly accurate and reliable service of a soccer ball and related methodologies of implementation and training.

2. Description of the Related Art

Playing soccer well requires a wide variety of skills. Players other than the goalkeeper may use any body surface other than the hands and arms. Skilled players are expected to acquire, at a minimum, a high degree of skill in the use of various surfaces of the feet, legs, chest, shoulder, and head to receive, control, and redirect the ball. A conservative estimate is that 21 body surfaces are routinely trained for use in receiving and directing the ball, not including the hands and arms for goalkeepers.

The ball may arrive from as close as less than a yard or from as far away as 70 yards, either on the ground or in the air, with a variety of speeds and spins. The player may be moving toward, away from, or at an angle to the direction of flight of the ball when it is received. The player may choose any of several actions with each contact ("touch") with the ball, depending on game conditions: control and retain possession of the ball, dribble the ball to a new location, pass it to a teammate, clear it out of a dangerous area, or shoot it toward the goal. Any of these actions may involve a choice of direction of the ball and the player after playing the ball. Goalkeepers must also master these same skills, plus the use of the hands for catching the ball or parrying it out of harm's way with the fingers or fists.

Each intersection of a body surface, a trajectory of flight including spin, the angle and speed of the player's movement relative to the ball, and the action to be taken by the player, represents one unique skill to be mastered through repetition and training. The entire matrix represented by all relevant combinations of these variables contains many hundreds of skills to be learned. This matrix will be termed hereinafter the "training matrix" for the sport of soccer. Other sports have their own training matrices based on the body or apparatus (e.g., bat) surfaces, trajectories, player movement, and player actions, used in those sports to receive and direct the ball.

Combined, these skills, applied to the player's first contact with the ball, are known in the soccer coaching community as "first touch." First touch is generally considered to be the cornerstone on which all other skills are built, and a mastery of first touch is the hallmark difference between great and merely good players.

Most of these skills must be executed in game conditions in a split second and, therefore, require not only the physical ability to perform the skill, but sufficient practice that the action is unconsciously selected and performed; that is, it must become a so-called "muscle memory" action. Achieving this level of skill requires many repetitions of performing each individual skill. In the ideal training environment, these repetitions take place in a short period of time.

There are obstacles to achieving these repetitions.

The simplest and most common obstacle is when a training partner is not available to serve the ball. This is a very common limit faced by players, especially youth in the United States.

Another common obstacle is training with a partner or group who are not skilled enough to accurately and repeatably provide the service needed to train the desired first touch skills. This is a problem everywhere in the world and at all levels of age and skill, but especially among young players who struggle with even basic types of service of the ball and, therefore, are not effective training partners for those seeking to acquire a better first touch. However, even highly proficient players encounter this problem for advanced first-touch scenarios. Certain skills require ball service that even the best players struggle to deliver and, therefore, are mastered by few players, not because they are inherently difficult to learn, but because they are difficult to train for lack of consistent, accurate service of the ball.

When a skilled coach is present, often that coach is the only one capable of serving the ball in the manner required, which means the coach's ability to train players is compromised by having to stand far away from the players being trained and focus on serving the ball rather than the actions of the player or players being trained.

Even more centrally, in order to accurately serve balls to a partner, a player must first have acquired a good facility with first touch, which, in a classic chicken-and-egg problem if all players are of roughly equal ability, can only be acquired through repetitions of receiving quality service of the ball that one's training partners are not yet capable of.

Similar problems have been recognized in certain other ball sports and have led to the creation of machines capable of serving a ball to a player. The most prominent examples are baseball, tennis and volleyball. The extension to soccer of the same concept, a machine for training first touch, seems at first glance natural and obvious. However, soccer presents demands that no machine has to date been able to satisfy.

A soccer ball is much heavier than baseballs and tennis balls and modestly heavier than a volleyball. It must travel much faster than a volleyball. As a result, the forces involved in serving a soccer ball are much higher than those for any other ball sport. A soccer ball traveling at 30 meters per second, the speed of an adult international player's fastest service, has approximately 1.6 times the kinetic energy of a baseball pitched at 90 miles per hour. Put another way, the kickback force of accelerating a soccer ball to 30 m/s would be sufficient to knock over backward most transportable baseball pitching machines and would cause others not secured to the ground to "walk" or slide on their legs relative to the ground with each pitch.

Soccer balls must be served from a variety of surfaces, from grass to various types of artificial surfaces including carpeted surfaces. A machine for serving soccer balls must not damage any such surface.

The physical area of service for soccer is tremendously larger than any other sport, as is the range of positions from which the ball must be served.

The variety of speeds and spins that must be applied to the ball is much broader for soccer than for these other sports.

Baseballs must be delivered from roughly the elevation of a pitcher's release point, while soccer balls are ideally served from close to the ground.

Soccer fields are commonly far from power sources and often have no storage facilities, unlike baseball, tennis and volleyball.

Soccer is commonly trained in moist conditions, unlike baseball, tennis, and volleyball; therefore, a machine for soccer must be capable of accurately serving moist balls, not just dry balls.

The various governing bodies of soccer permit a wide variation in the diameters and weights of soccer balls, while balls in other sports are more tightly regulated. Soccer balls are subject to differences, from ball to ball or for the same ball over time, in their internal air pressure, unlike a baseball.

Soccer balls have relatively soft surfaces that are easily damaged, they have hidden seams, and the ball is highly compressible. Baseballs are tough, abrasive, essentially incompressible, and have protruding seams.

The training matrix for soccer is at least two orders of magnitude larger than that of any other ball sport, which implies a much broader set of usage scenarios to support in a machine for serving balls.

These demands, taken together and unique to soccer, pose design and engineering problems not seen in the design of ball-serving machines for other sports. To the inventors' knowledge, no machine capable of successfully addressing these unique demands of the sport of soccer has been introduced.

BRIEF SUMMARY

The embodiments of the present disclosure are directed to, in one form, a system for delivering objects, including a methodology for training individuals in handling the objects. The system includes a unique device that can be configured to deliver objects along a single trajectory with precision and reliability. In one embodiment, automated controls enable a single user to self-train in receiving and handling the object, which is facilitated by a remote control, such as a radio frequency or microwave controller.

In accordance with one embodiment of the disclosure, a device for delivering a ball is provided. The device includes an accelerator that accelerates and delivers the ball with selectable motion characteristics, such as linear acceleration and angular acceleration.

In accordance with another aspect of the foregoing embodiment, the device is further optimized to provide the described acceleration and motion characteristics when the surface of the ball is moist or moisture is present on surfaces of the accelerator that contact the ball. In accordance with this aspect of the foregoing disclosure, the device is further optimized to minimize marking of and damage to the ball surface during acceleration.

In accordance with the foregoing embodiment, the device further includes an assembly that adjusts the position of the accelerator to adjust the exit trajectory of the ball about a yaw axis, an elevation axis, and a spin axis of the ball. Ideally, the yaw axis, elevation axis, and spin axis are all axes of rotation (in contrast to linear adjustments in a Cartesian system). Preferably the adjustment about the three axes follows a stacking order wherein the assembly is structured to provide adjustment about the three axes in an order that maintains the non-adjusted settings. For example, an adjustment about the yaw axis will not require adjustment in the elevation and spin in order to provide the same trajectory and flight in a different yaw direction. A further adjustment in the rate of spin of the ball is also provided.

In accordance with another aspect of the foregoing embodiment, a ball feed assembly is provided to load or feed the ball in to the accelerator. In one embodiment, the ball feed assembly includes a ball-centering mechanism that feeds each ball to a precise location in the accelerator. Without such precise positioning of the ball on each load, the motion characteristics of the ball will not be the same with each launch, thus altering the exit trajectory and flight path of the ball.

In accordance with another aspect of the foregoing embodiment, the ball feed assembly includes a ball actuator that feeds the ball at a controllable speed into the accelerator. It has been found that varying the speed of feeding the ball in to the accelerator will alter its motion characteristics and hence its flight path.

In accordance with a preferred embodiment, the accelerator includes two coplanar counter-rotating wheels positioned to receive the ball between the wheels as the wheels spin to accelerate and eject the ball with linear acceleration, and in a preferred embodiment with both linear acceleration and angular acceleration.

In accordance with another aspect of the present disclosure, the accelerator is positioned above the ground so that the exit point of the ball is in a range of 18-32 inches, and preferably in a range of approximately 18-20 inches in order to simulate the location from which a human soccer player kicks a ball.

In accordance with another aspect of the foregoing embodiment, a platform for supporting the accelerator and the assembly is provided. Ideally, the platform is mounted on wheels that rotate about axes, and the platform is preferably positioned below the wheel axes to provide maximum stability when a ball is accelerated and launched from the accelerator.

In accordance with another aspect of the present disclosure, a device is provided that implements a system of entertainment analogous to computer games that includes a sequence of levels of increasing difficulty, each level consisting of tasks to be completed using ball skills, with an objective to be met at each level in order to proceed to the next level, and automated scorekeeping so as to permit competition against the system and against other players. Ideally, the system utilizes the ball delivery device of the present disclosure, and in particular the system of entertainment pertains to soccer.

In accordance with one embodiment of the disclosure, a soccer ball delivery device is provided that includes a wheel assembly adapted to receive, accelerate, and launch the soccer ball, the wheel assembly having a support with a mechanism that varies an elevation angle at which the soccer ball is launched, a main post assembly that includes a post to support the wheel assembly and wheel assembly support, a turntable to support the post, and a yaw mechanism to rotate the turn table about an axis oriented substantially vertical to adjust a yaw angle at which the soccer ball is launched. The wheel assembly further includes a mechanism to apply spin to the ball on any axis perpendicular to the vector of flight of the ball on exit from the device. The device further includes a base unit to support the main post assembly, and a power source to supply electrical power to the motors in the wheel assembly. Ideally, the power source is portable, e.g., utilizing one or more rechargeable batteries.

In accordance with one aspect of the disclosure, adjustments to the motion characteristics of the soccer ball are made manually through adjustment mechanisms on the device. In a preferred embodiment adjustments are made via motorized assemblies associated with the wheel assembly and its support structure.

In accordance with another aspect of the disclosure, a system for delivering soccer balls is provided that includes the soccer ball delivery device of the present disclosure and further includes a ball feed unit to feed the soccer ball into the wheel assembly, the ball feed unit having a hopper to hold a plurality of balls to be fed into the wheel assembly and a feed system to deliver the soccer ball into the wheel assembly.

In accordance with another embodiment of the disclosure, a soccer ball delivery system is provided that includes an electronic control system having stored training programs for selective use. Stored training programs can be customized for individual users and executed in either pre-programmed or real-time-selected sequences.

In another embodiment of the disclosure, a soccer ball delivery system and device is provided that includes the use of target nets. In accordance with one aspect of this embodiment of the disclosure, the target nets are coupled to an electronic control system and use a target sensor to detect strikes in a target zone.

In accordance with another embodiment of the disclosure, an automated ball return device is utilized to collect and return balls to a multiple ball hopper associated with the soccer ball delivery device. In accordance with one aspect of this embodiment of the disclosure, one soccer ball delivery device delivers balls to a location and in a manner suitable for a player to receive and redirect to a second location (the ball-serving device), while a second soccer ball delivery device at that second location collects the ball or balls so redirected and returns them to the ball collection system of the first device (the ball-return device). In accordance with this aspect, the ball-return device may be of the same basic design as the ball-serving device. Alternatively, the ball-return device may have a subset of the capabilities of the ball-serving device.

In accordance with another embodiment of the disclosure, the soccer ball delivery device includes an energy-absorbing cart that provides a platform for launching of soccer balls without causing damage to the supporting surface, such as a grass field.

In accordance with yet another aspect of the disclosure, a soccer ball delivery device is provided that can be easily and quickly broken down for storage and transportation in the trunk of small vehicles and can be carried by a single individual from a parking lot to a field or from a facility to a field and back.

In accordance with another aspect of the present disclosure, a gimbal mechanism is provided for a soccer ball delivery device that carefully optimizes the range of motion of the wheel assembly in receiving, accelerating, and launching a soccer ball.

In accordance with another embodiment of the disclosure, a method is provided for aiding in the development of soccer ball skills. Ideally, the method utilizes the unique soccer ball delivery device and system of the present disclosure. The method includes utilizing training skill sets comprised of training skills selected from one or multiple training domains. The method can also include developing internally and externally valid training curricula for a ball sport, such as soccer.

In accordance with another aspect of the method of the present disclosure, the training curricula developed above are applied to a user in order to assess a user's proficiency and develop an individualized training program based on the assessment.

In accordance with another aspect of the method of the present disclosure, a training program selected in accordance with the foregoing player assessment and designing of a training program is implemented utilizing a soccer ball delivery device and system formed in accordance with the present disclosure.

In accordance with another embodiment of the disclosure, a device for delivering an object is provided that includes an electrically driven wheel assembly to receive, accelerate, and launch an object; a main post assembly to support the wheel assembly including means to adjust the trajectory of the object; a base unit to support the main post assembly; and a control mechanism to impart motion characteristics to the object. Unless noted otherwise, "trajectory" includes the spin of the ball as well as yaw and elevation, which will affect its flight path.

In accordance with another aspect of the foregoing embodiment, the control mechanism includes an electronic controller adapted to store and execute a training program.

In accordance with another aspect of the foregoing embodiment, a radio frequency receiver and a portable transmitter are used to enable remote control of the device. Ideally, the device includes a power source to supply electrical power, and in one preferred embodiment, the power source is a battery pack containing one or more batteries, preferably rechargeable batteries.

In accordance with another embodiment of the disclosure, a method for developing a training curriculum using an object delivery device is provided. The object delivery device includes an electrically driven wheel assembly to receive, accelerate and launch the object, an assembly to adjust a trajectory of the object, a device means to store a plurality of objects and feed them into the wheel assembly, and a software-programmable control mechanism to impart motion characteristics to the object, the method including selecting a training skill set of at least one training skill based on generally accepted principles of expert trainers as to skills required for proficiency; selecting a sufficiently large sample of players of known external rank; collecting data by having each player of the sample test with the device each training skill of the training skill set and recording the player's success or failure with the training skill; correlating success or failure of the player at each training skill with the player's known external rank; selecting which training skills to include in the training curriculum based on how strongly each player's success or failure at each training skill correlates with the player's known external rank; grouping the training skills to be included in the training curriculum into one or more training levels; for each training level, identifying a subset of one or more training skills that are the most highly correlated to the training level; and confirming the training curriculum by assessing a separate sample of players of known external rank according to the curriculum, then correlating the assessment to a further set of players' known external ranks.

As will be readily appreciated from the foregoing, the various embodiments of the disclosure successfully solve the above-described problems of current machines. It is designed to provide any service of which a human international-class player is capable, including, but not limited to, any speed, spin and trajectory associated with the most highly skilled human players. It absorbs, rather than transmits into the ground, the very high kickback forces that result from accelerating a soccer ball to maximum speed. It provides automated ball service so that a player can self-train, and a coach if present may stand next to the player being trained rather than at the point of service. It is computer-controlled, which, among other benefits, provides a library of service types for training the entire matrix of first touch skill scenarios. It is battery-powered and highly transportable. Because of the unique wheel architecture, it can serve even moist balls with a high degree of accuracy. Trajectories can be stored, and then later recalled with a high degree of repeatability.

BRIEF DESCRIPTION OF THE SEVERAL VIEWS OF THE DRAWING(S)

The foregoing features and advantages of the present disclosure will be more readily appreciated as the same become better understood from the following detailed description when taken in conjunction with the accompanying drawings, wherein.

Figure 21A:
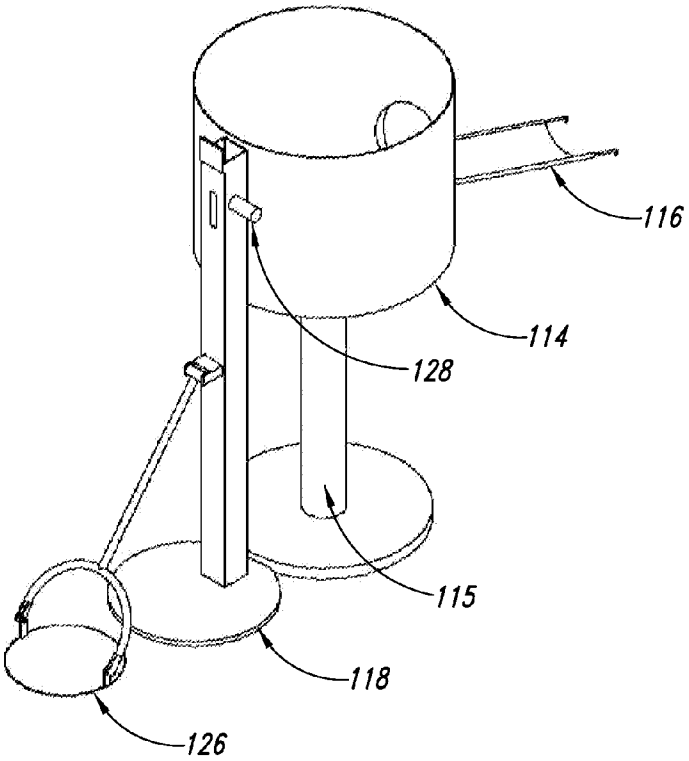
Figure 21B:
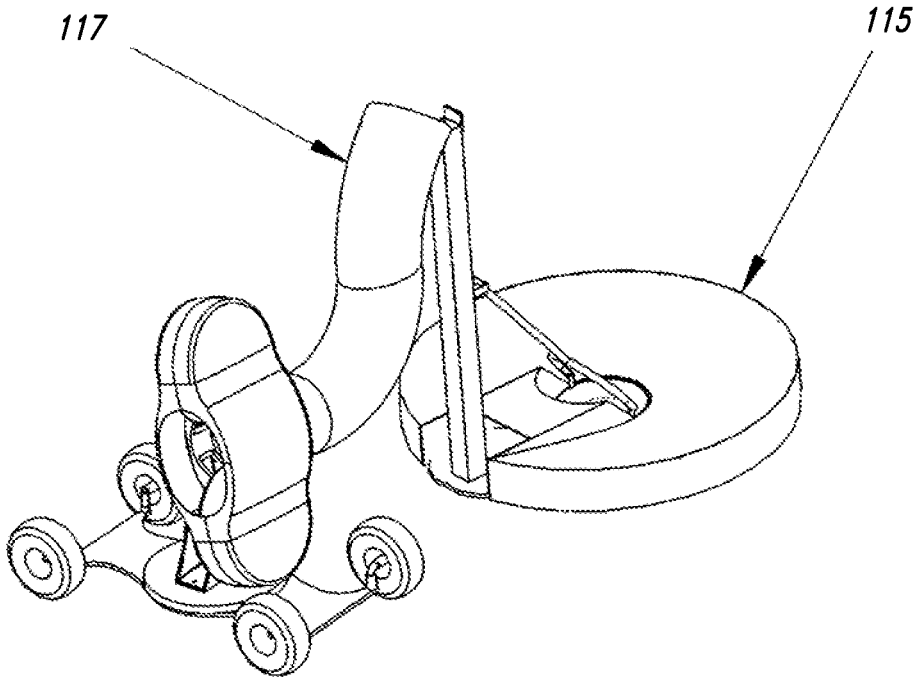
Figure 22:
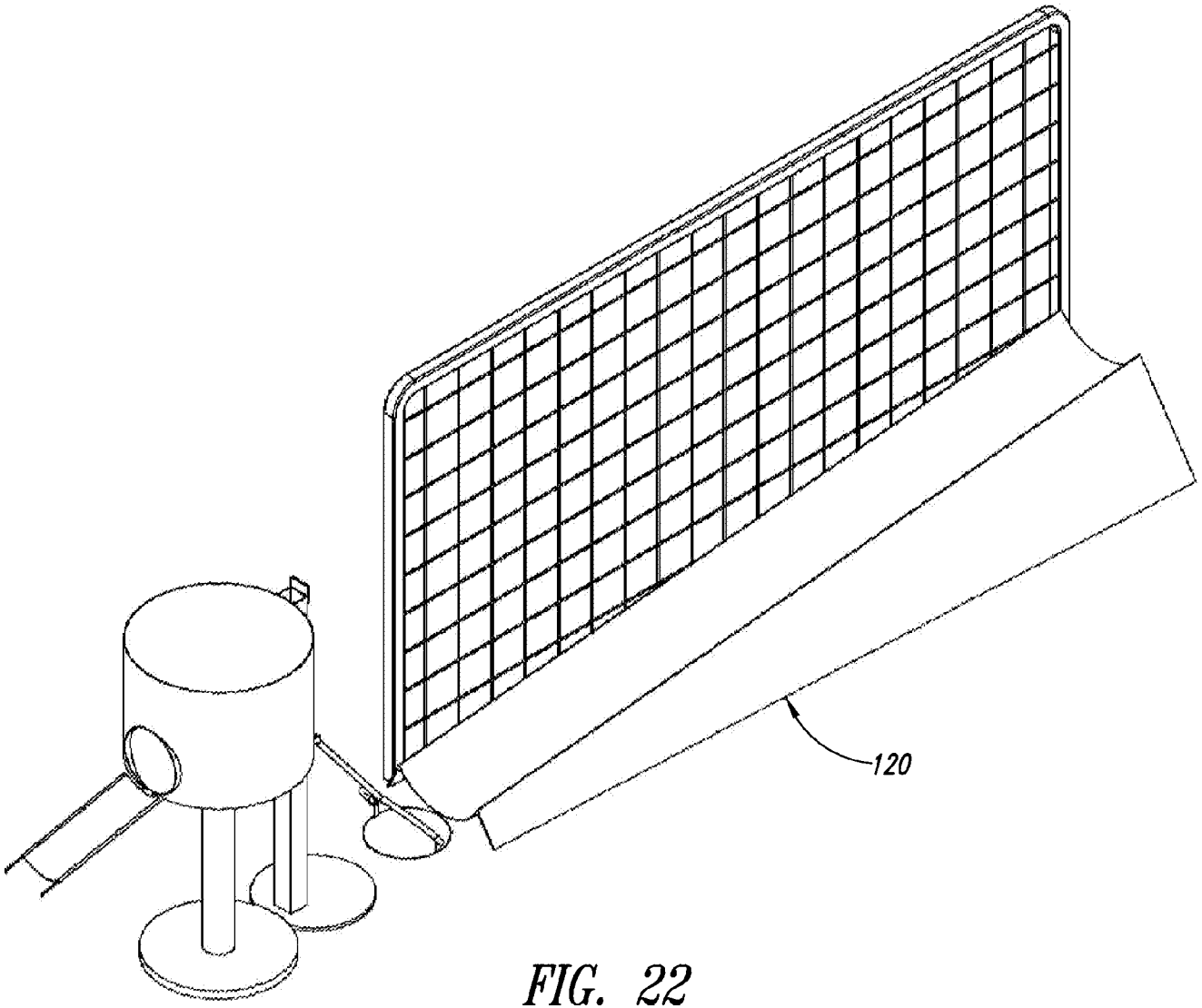
Figure 23:
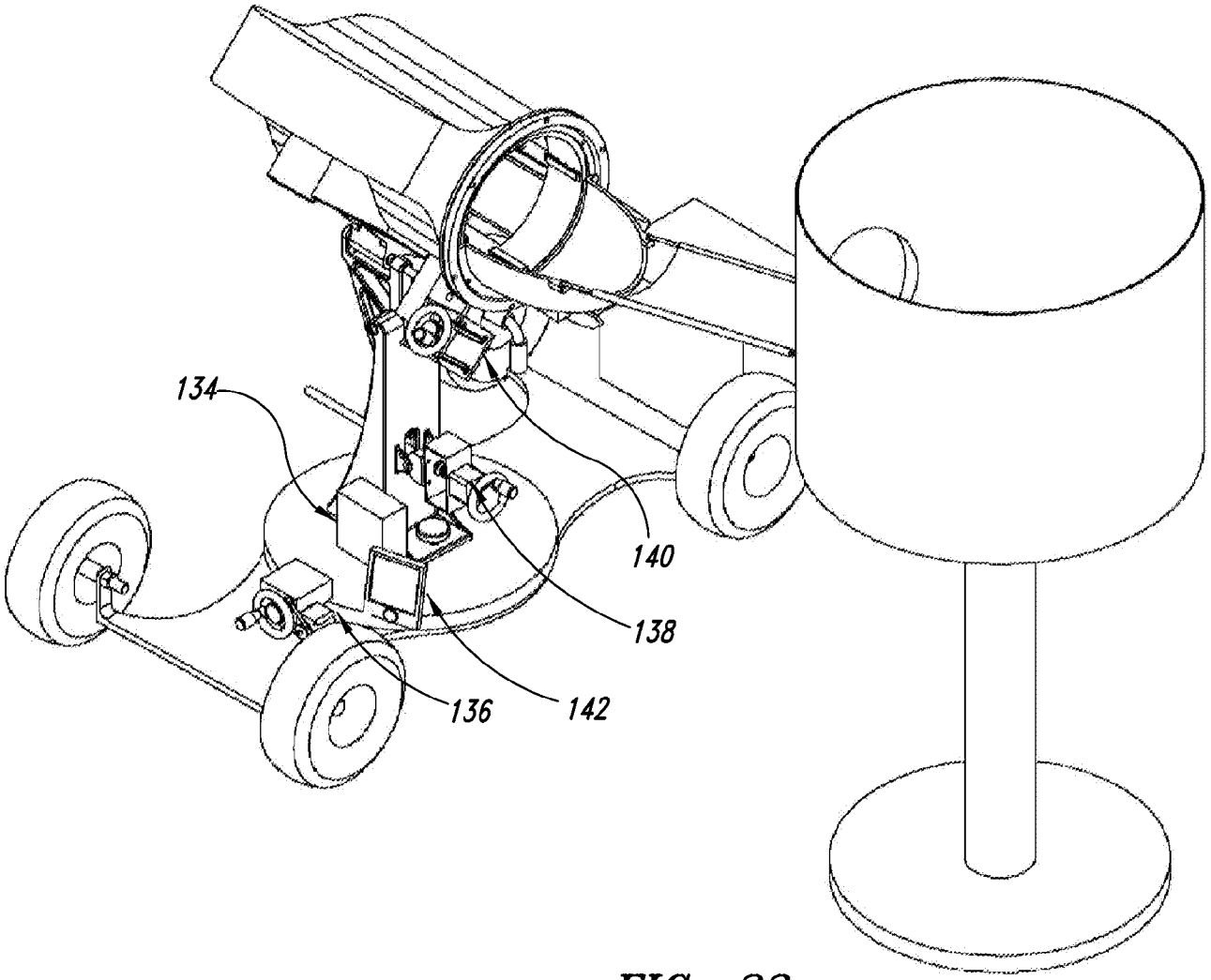
Figure 24:
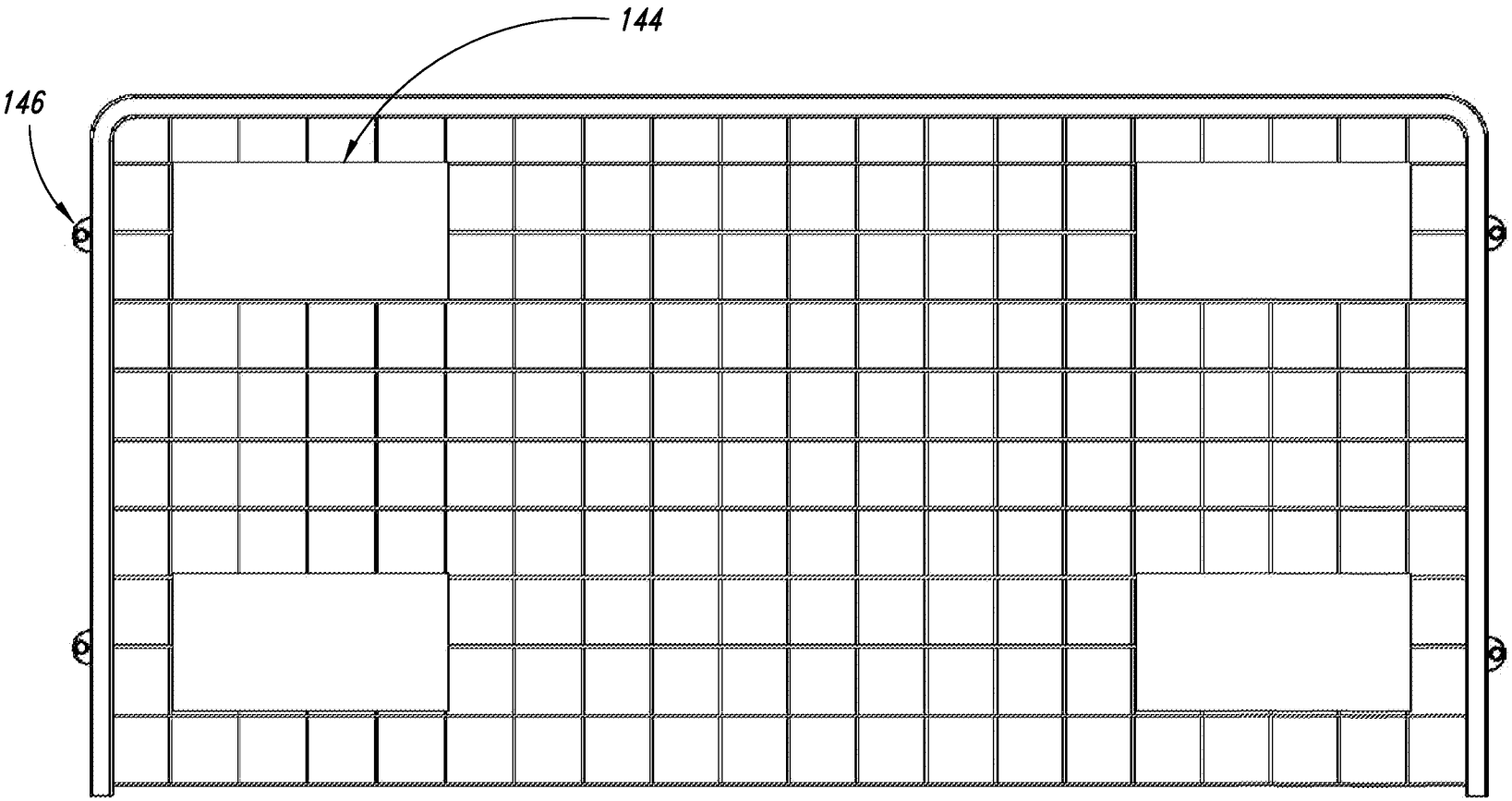
Figure 25:
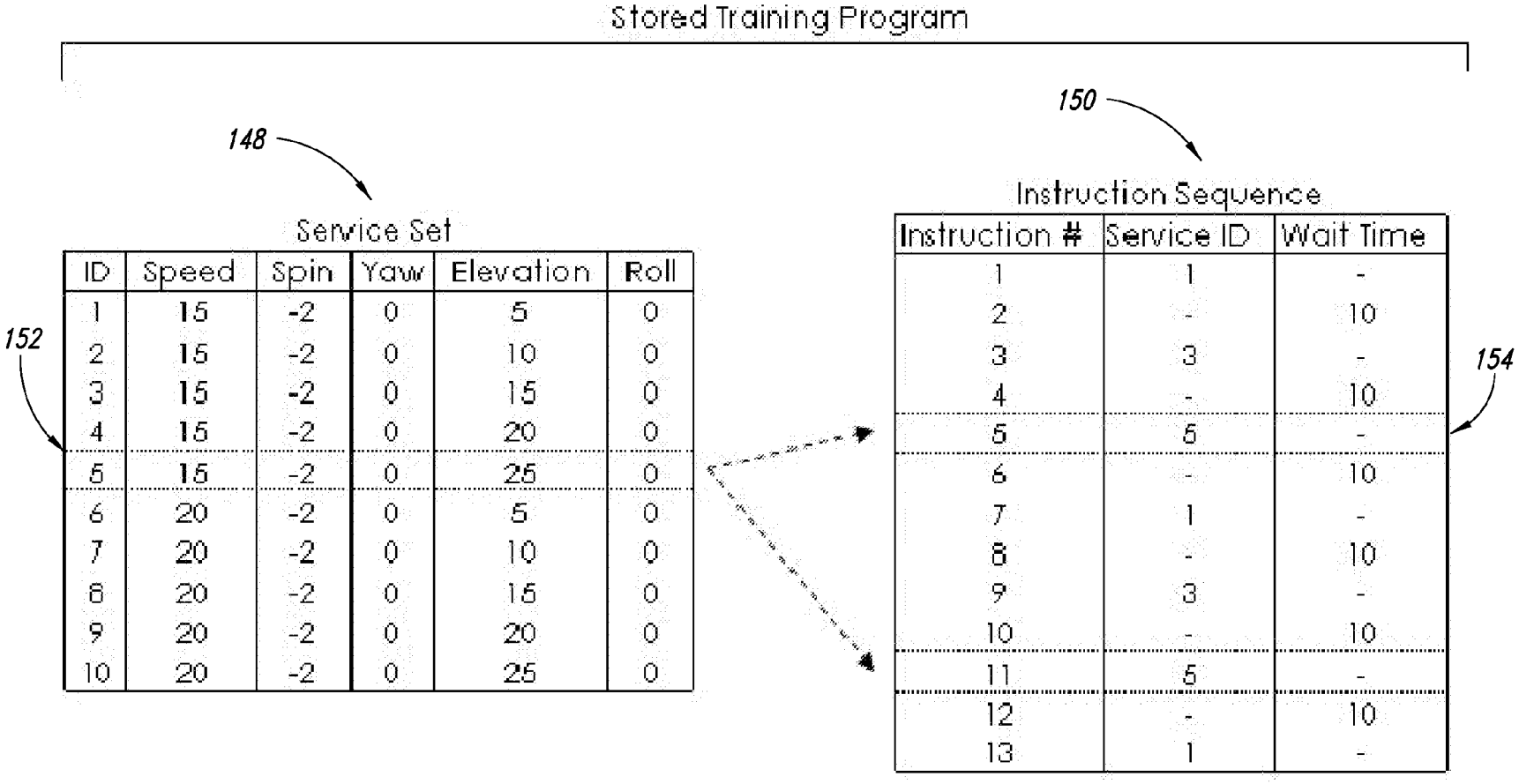
Figure 30:
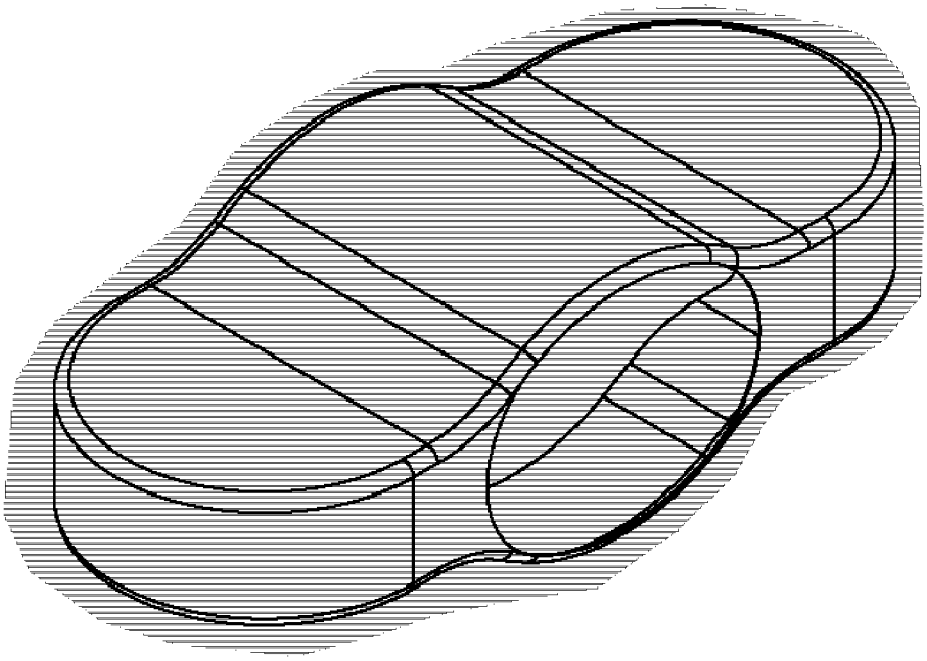
Figure 31:
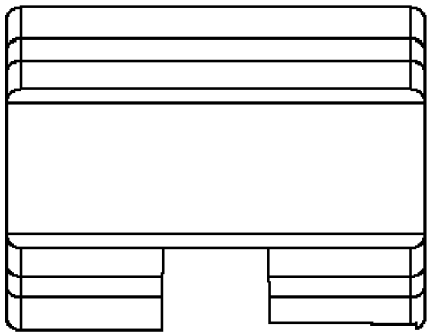
Figure 32:
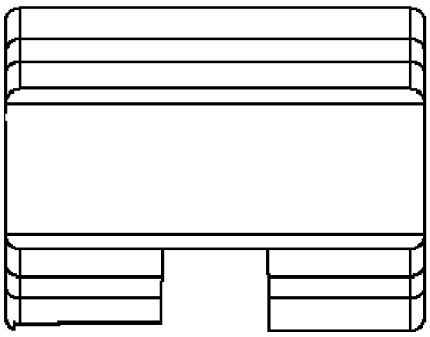
Figure 33:
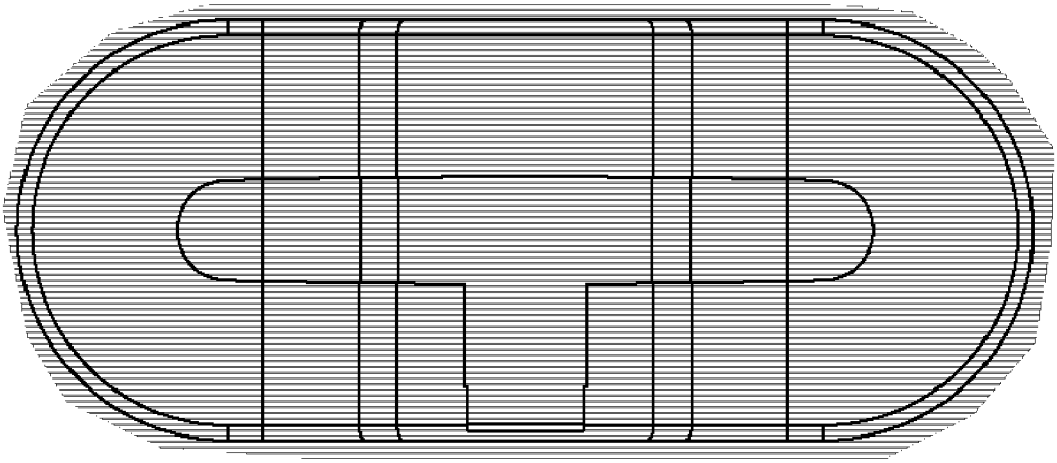
Figure 34:
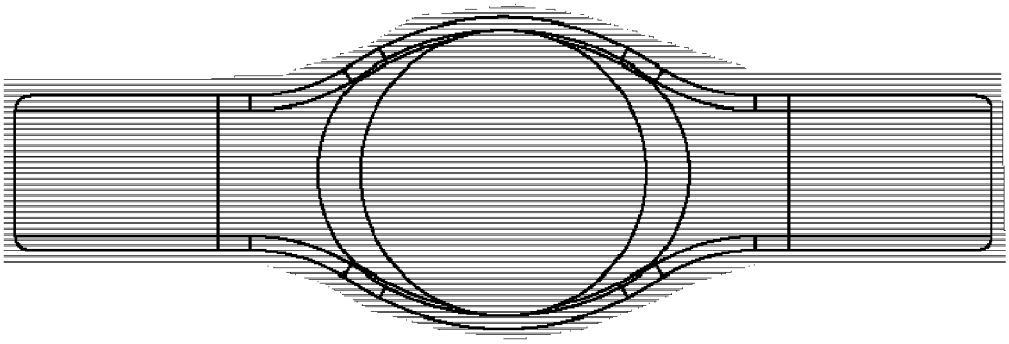
Figure 35:
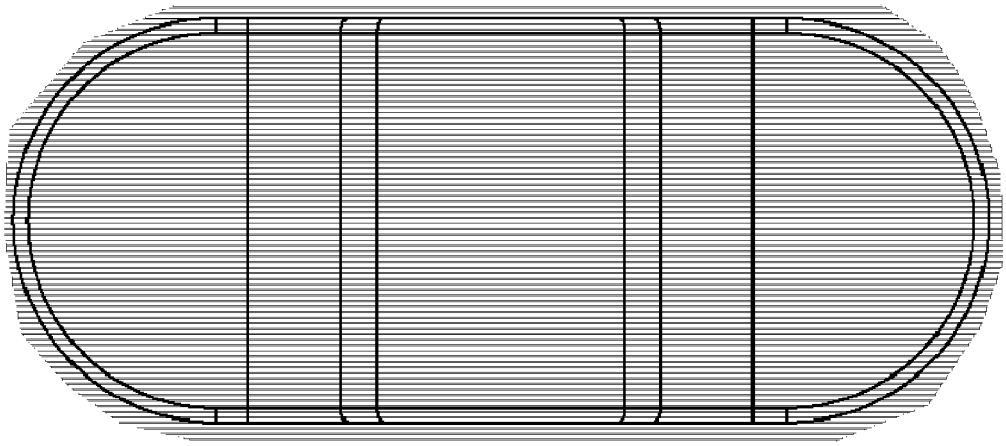
Figure 36:
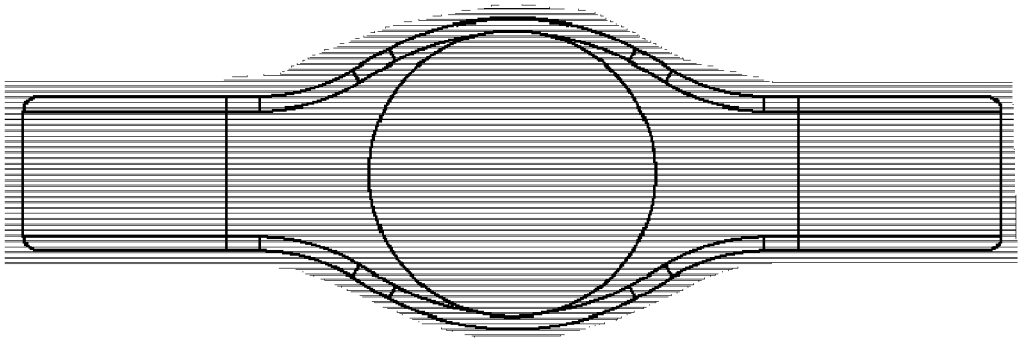
Figure 37:
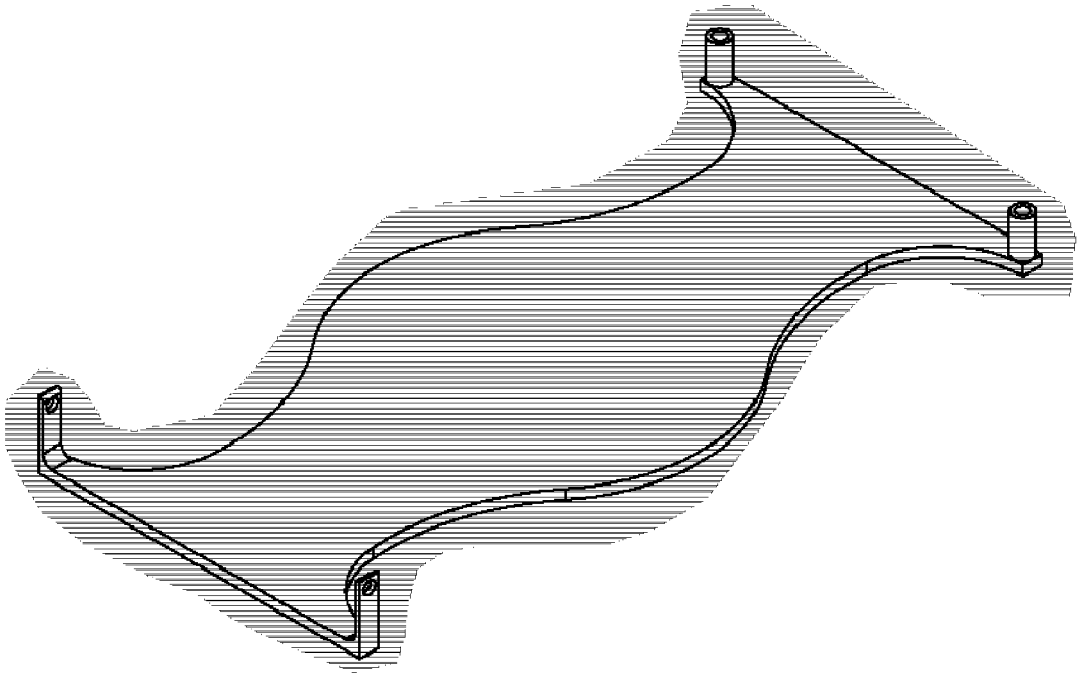
Figure 38:
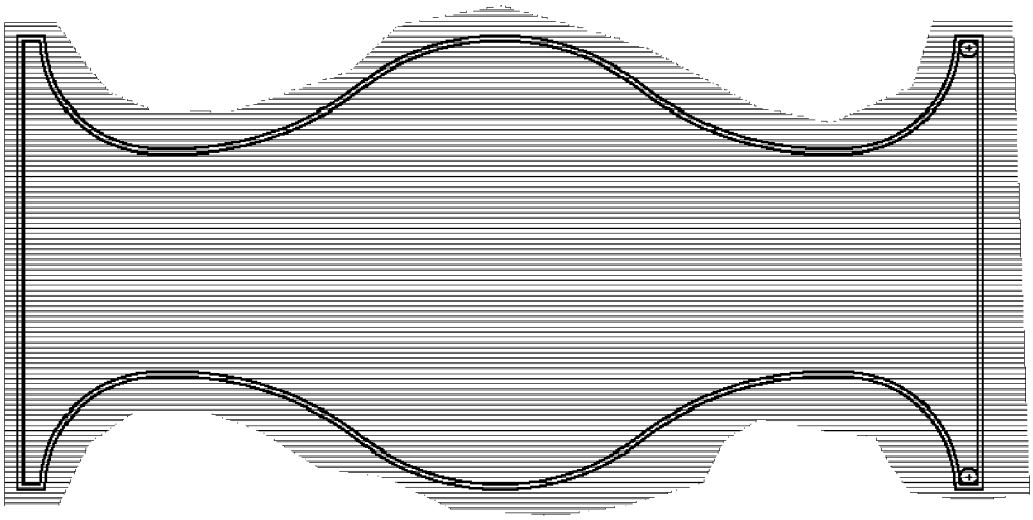
Figure 39:
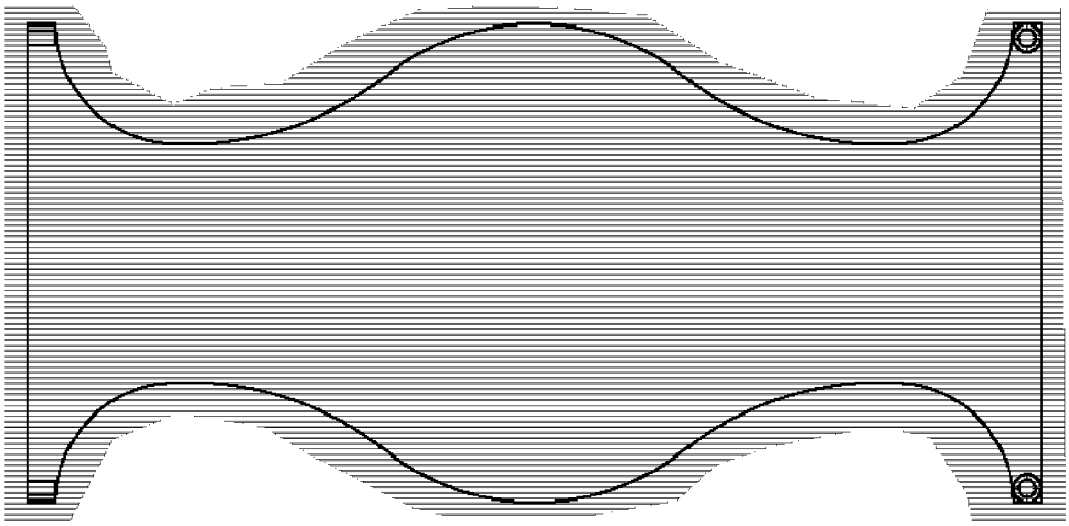
Figure 40:
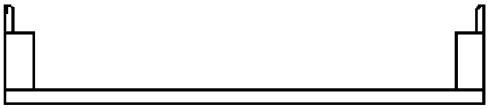
Figure 41:
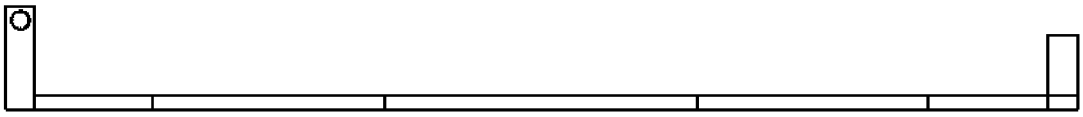
Figure 42:
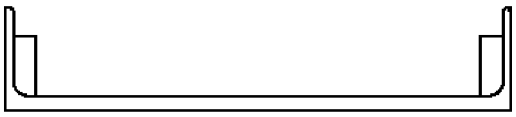

FIGS. 21A-B are isometric views of alternative ball feed unit formed in accordance with one embodiment of the disclosure;

FIG. 22 is an isometric view of a ball feed system with recovery net formed in accordance with the present disclosure;

FIG. 23 is an isometric view of a soccer ball delivery system formed in accordance with one embodiment of the present disclosure;

FIG. 24 is a front view of a target formed in accordance with one embodiment of the present disclosure;

FIG. 25 is a diagram illustrating a stored training program formed in accordance with one embodiment of the present disclosure;

FIG. 26 is a diagram illustrating a stored training program formed in accordance with an alternate embodiment of the present disclosure that includes semi-random ball service;

FIG. 27 is a diagram illustrating a first touch training skill set formed in accordance with a method of the present disclosure;

FIG. 28 is a diagram of a compound training skill set formed from a plurality of training skill sets in accordance with a method of the present disclosure;

FIG. 29 is an illustration of a hierarchy of training levels formed in accordance with a method of the present disclosure;

FIGS. 30-36 are an isometric view, left side view, right side view, bottom plan view, front elevational view, top plan view, and a back elevational view, respectively, of a design embodiment of a cowling formed in accordance with the present disclosure, and FIGS. 37-42 are isometric view, top plan view, bottom plan view, left side view, front elevational view (the back elevational view being substantially a mirror image thereof), and right side view, respectively, of a design embodiment of a platform formed in accordance with the present disclosure.

DETAILED DESCRIPTION

Figure 2:
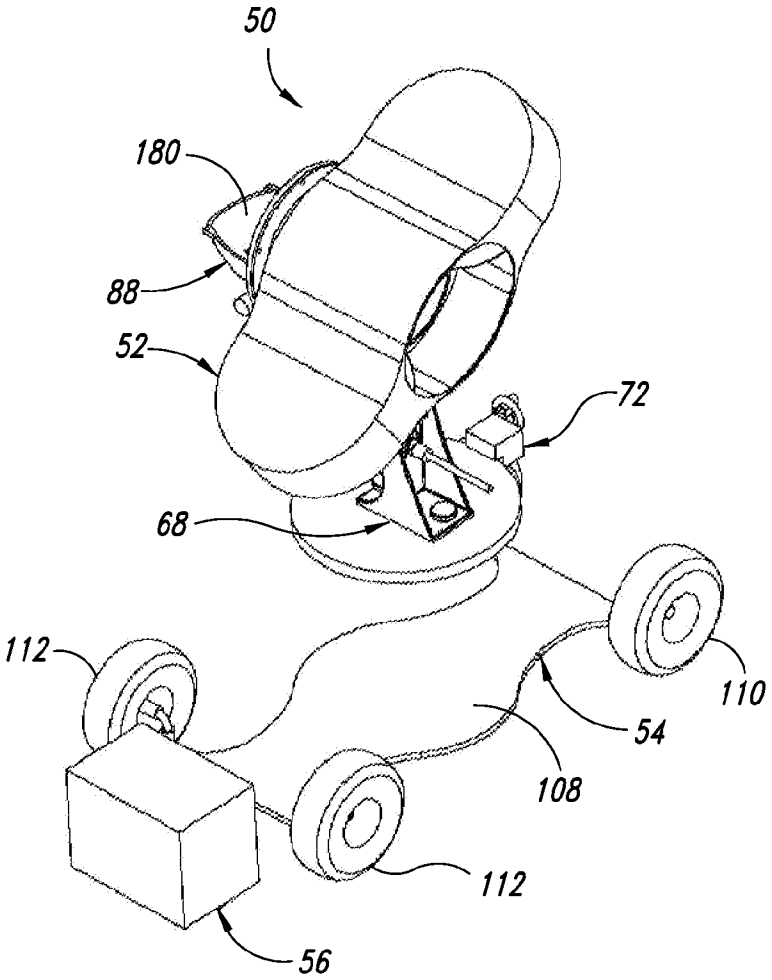
FIGS. 1 and 2 are isometric views of a soccer ball delivery device formed in accordance with one embodiment of the disclosure.
Figure 1:
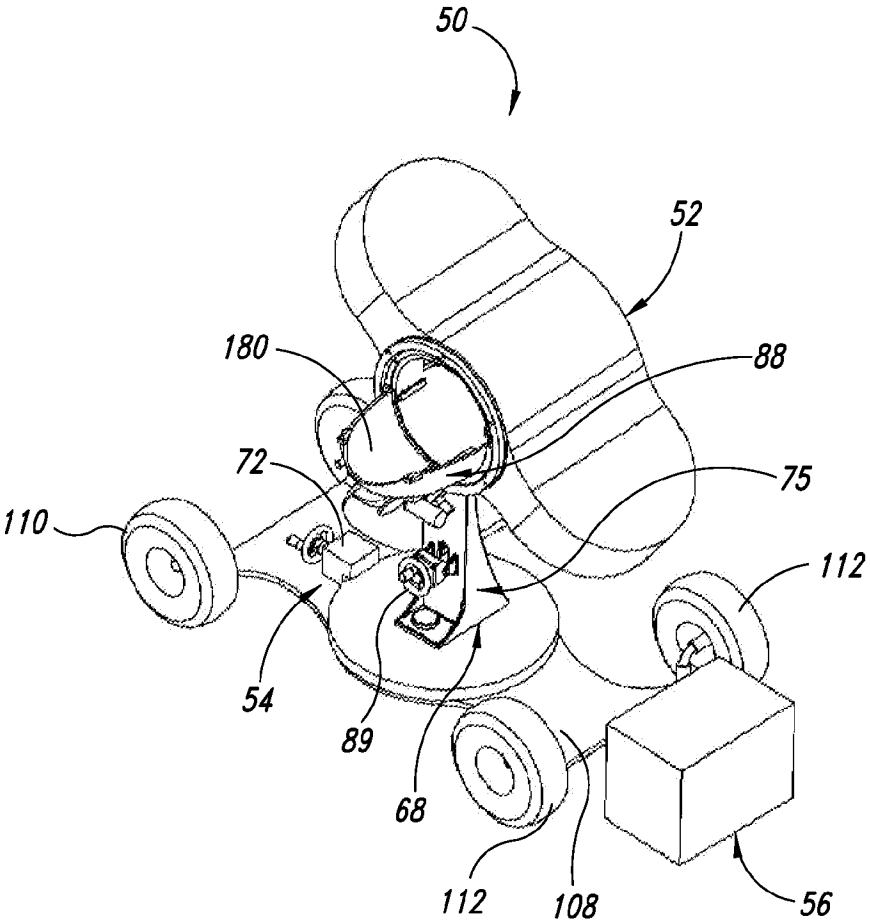
Figure 4:
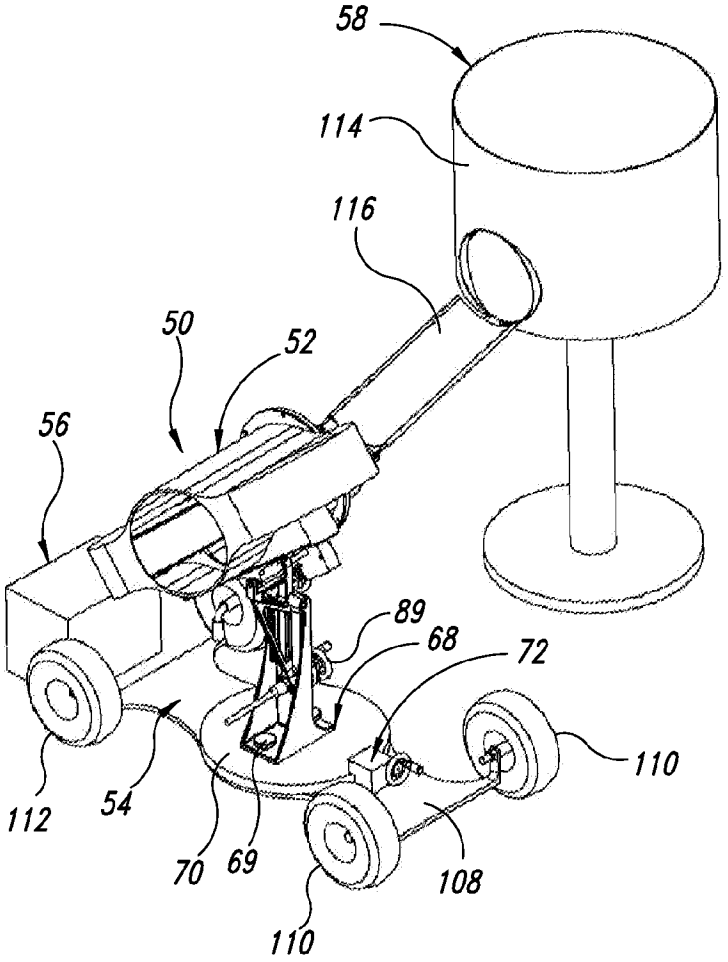
FIGS. 3 and 4 are isometric views of a soccer ball delivery device formed in accordance with another embodiment of the disclosure.
Figure 3:
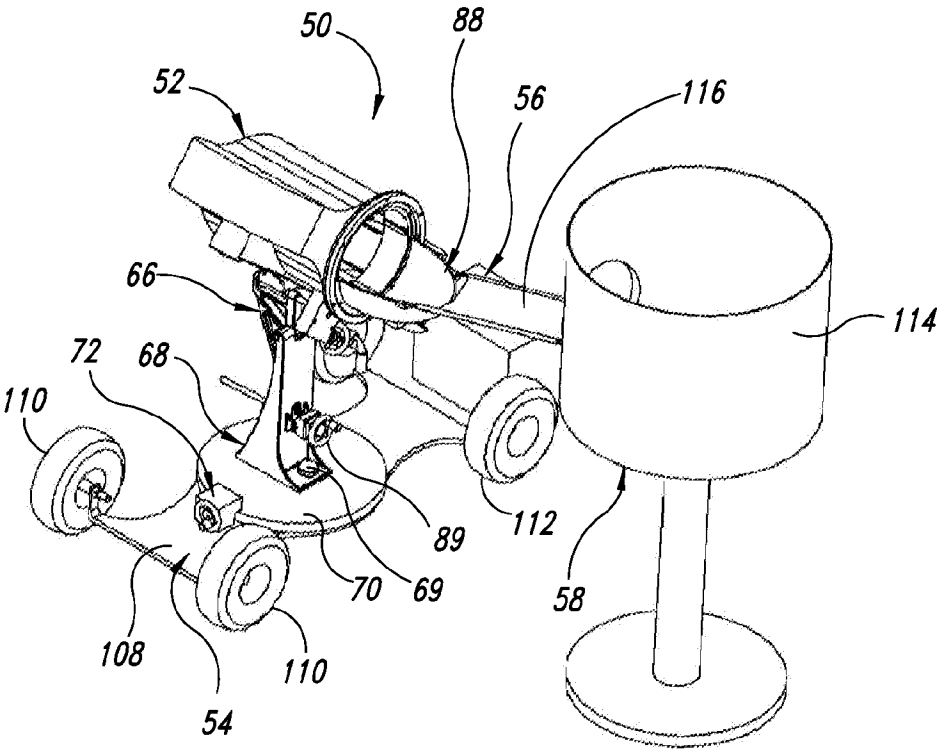
Figure 6:
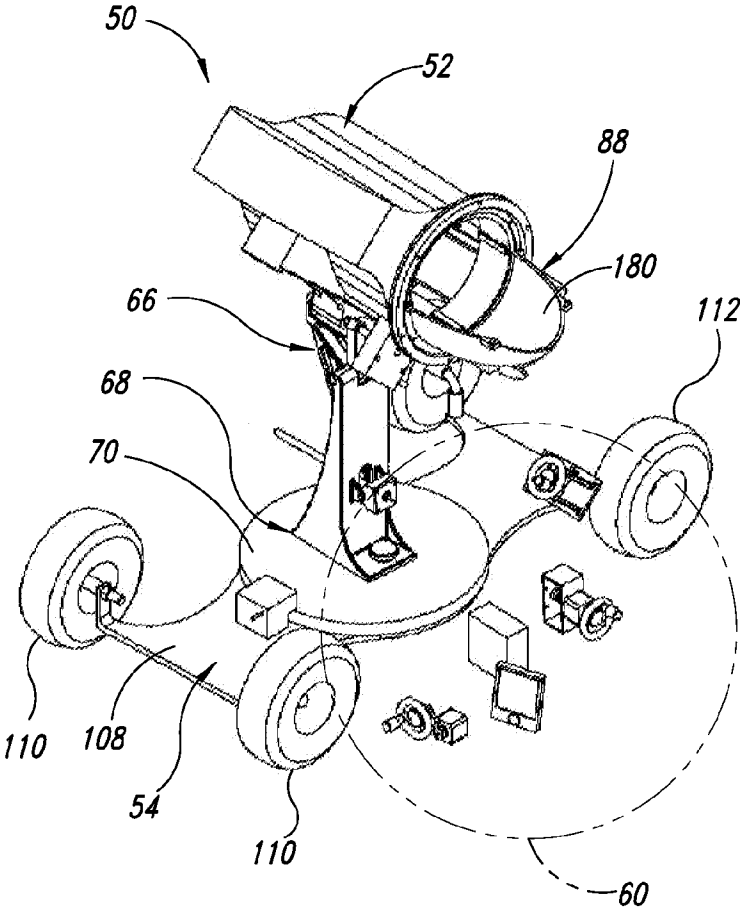
FIGS. 5 and 6 are isometric views of a further embodiment of a soccer ball delivery device formed in accordance with the present disclosure.
Figure 5:
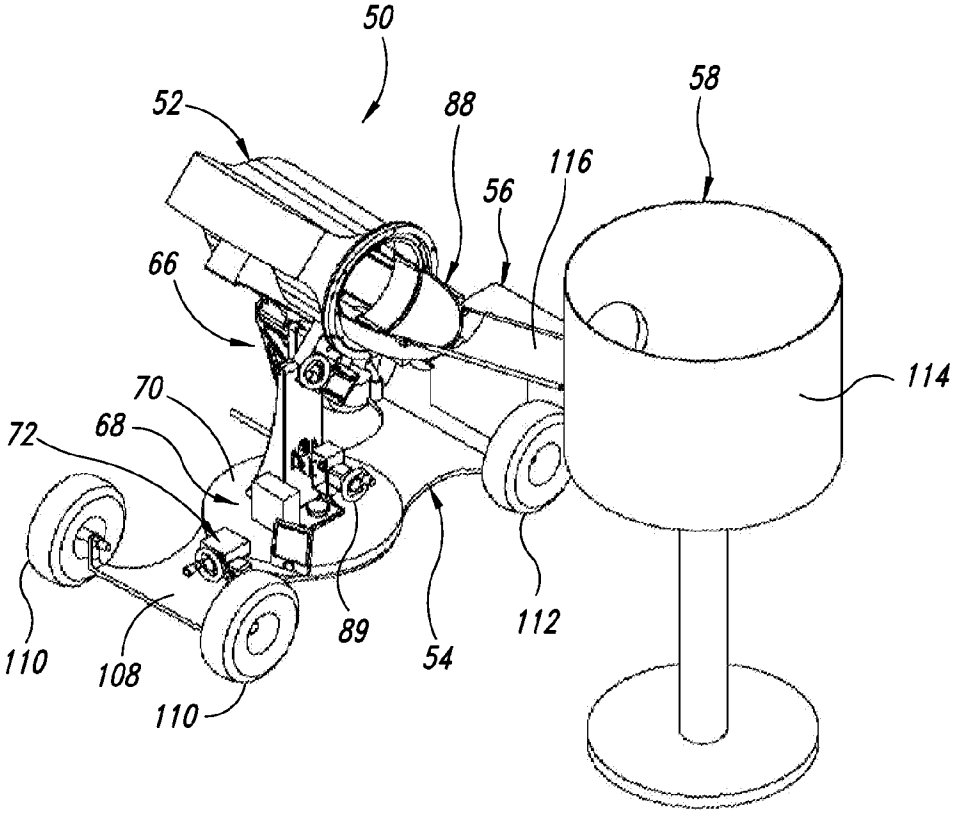

Referring initially to FIGS. 1 and 2, a representative embodiment of a soccer ball delivery device 50 is shown, generally comprising a drive train 52, a base unit 54, and a power source 56. In most applications, the device 50 will also include a ball feed unit 58 as shown in FIGS. 3 and 4. In one embodiment an electronic control system 60 is used to control one or more of the drive train 52 and ball feed unit 54, as illustrated in more detail in FIGS. 5 and 6.

In a basic embodiment, the device 50 is designed to:

1. Accurately and repetitively reproduce any ball service a human expert player can produce, measured in terms of ball velocity, degree of spin, axis of spin, and trajectory of initial exit from the device 50:
2. Facilitate easy transportation within a facility and between facilities;
3. Absorb the kickback forces, which can exceed 300 pound-force, involved in accelerating a one pound ball to the fastest velocities a human expert player can achieve, without changing the devices position for the next service ("walking") and without damaging the surface on which the device 50 rests;
4. Operate on a battery pack for typically 4-6 hours of normal usage and 3 or more hours of heavy usage without the need to recharge the batteries;
5. Not substantially mark or damage balls served by the device 50; and
6. Perform accurately with wet balls as well as dry balls.

In the embodiment with an electronic control system 60 and a ball feed unit 58, the device 50 is further designed to:

7. Allow a player to self-train without the need for an operator of the device 50;
8. Allow a coach to control the device remotely while standing in the most advantageous position for instructing players, at a distance from the device 50;
9. Allow the creation and use of software training programs to reproduce fixed sequences of ball service or semi-randomly generated training sequences of ball service, as well as a marketplace for such training programs;
10. Facilitate objective and valid methods, not feasible in the absence of this or a similarly capable device, of assessing and training players; and
11. Facilitate business models associated with the training of soccer players not feasible in the absence of this or a similarly capable device.

These unique features underlie the design and selection of components and their assemblies in the implementation of the device 50.

Drive Train

Figure 9:
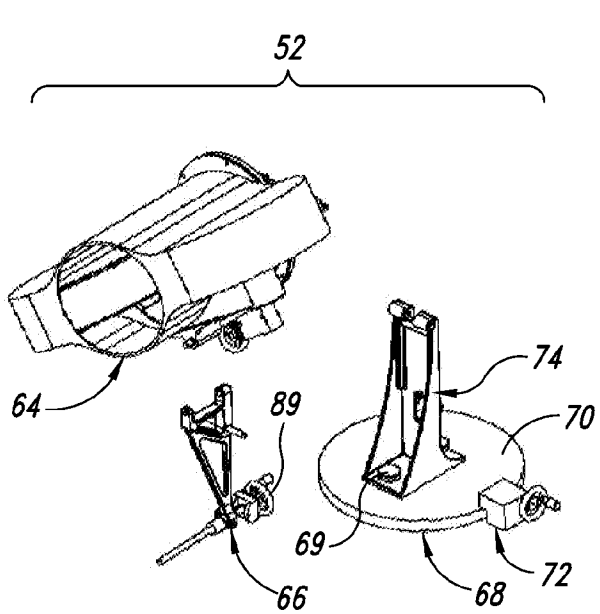
FIGS. 7 and 8 are isometric views and FIG. 9 is an exploded isometric view of a drive train of the present disclosure.
Figure 8:
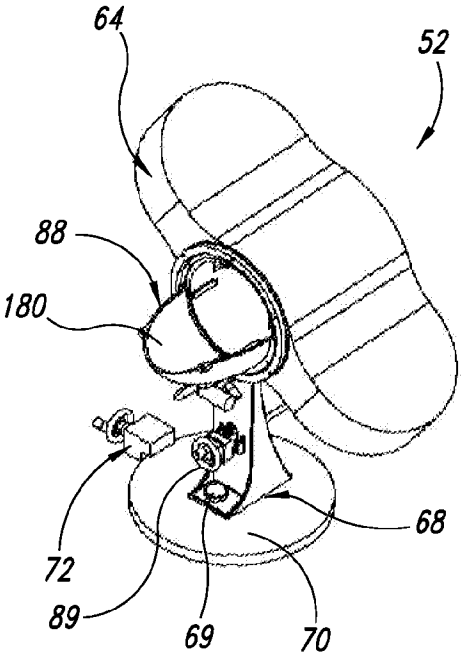
Figure 7:
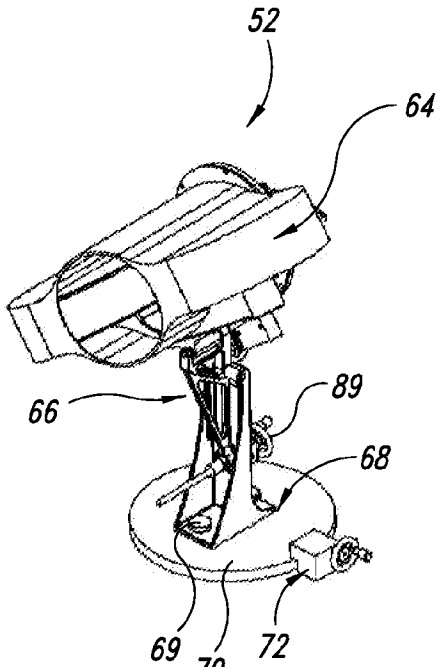

The drive train 52, shown in more detail in FIGS. 7, 8, and 9, generally includes a wheel assembly 64, an elevation assembly 66, and a main post assembly 68.

The wheel assembly 64 has, as its two basic functions (a) accelerating a soccer ball in a straight-line axis while (b) applying spin to the ball on an axis normal to the axis of acceleration, using two counter-rotating wheels with tires as the means of linear acceleration and imparting spin. It is to be understood that spins not normal to the axis of rotation utilizing a variation in the architecture of the wheel assembly 64, such as having converging axes of the wheels can be used.

The rest of the drive train 52 provides structural support for the wheel assembly 64 and a means to orient in space the axis of acceleration and axis of spin of the soccer ball. The main post assembly 68 provides a means of aiming left or right of a centerline, with the axis of rotation perpendicular to the ground (the "yaw axis"). The elevation assembly 66 provides a means of aiming upward or downward on an axis perpendicular to the yaw axis (the "elevation axis"). The wheel assembly 64, in addition to its two basic functions, also has the means to rotate the axis of spin perpendicularly with respect to the elevation axis (the "roll axis").

Detailed Functional Discussion of Yaw, Elevation and Roll Axes

The specific arrangement of axes, design and selection of components of the drive train 52 and arrangement into subassemblies collectively represents a complex and innovative solution to difficult design problems not previously solved in a ball-serving machine for any sport.

1. They are designed to permit a ball to be served with any trajectory and axis of spin of which an expert human player is capable, while:
2. minimizing torque on each axis and, therefore,
3. minimizing weight devoted to structural and mechanical components.

The drive train is also innovative in:

4. its light weight (approximately 70 pounds) needed to accomplish these objectives, while
5. providing adequate stiffness to safely absorb kickback forces without affecting the trajectory of the ball;
6. the minimal number of components required;
7. the ease of dismounting for transportation; and
8. the small size (less than 5 cubic feet) which allows it to fit, along with the base unit 54 and other components, into the trunk of a small car such as a Honda Civic.

In the embodiment with an electronic control system 60, by minimizing torque across the three axes, the design also:

9. minimizes the weight and size of electromechanical components needed to move the axes then lock them in position, and
10. minimizes the power drawn from the power source 56.

The ranges of the three axes and their combination are determined by requirements for training players and reproducing ball service commonly seen in the game as played by humans. The direction of acceleration of the ball is determined in two polar coordinates, that of the yaw axis (a major vertical axis perpendicular to the ground) and that of the elevation axis (a major horizontal axis parallel to the ground), respectively.

Zero degrees of the yaw axis represents a direction of acceleration perpendicular to the major vertical axis of the base unit 54. The maximum range of motion of the yaw axis is approximately plus 15 to 20 degrees to minus 15 to 20 degrees, resulting in a total range of motion of 30-40 degrees. This corresponds to the left-to-right range required of typical soccer training scenarios.

Zero degrees of the elevation axis represents a direction of acceleration parallel to the ground, with positive angles pointing upward and negative angles pointing downward. The maximum range of motion of the elevation axis is from approximately zero to −5 degrees (slightly downward) up to approximately +30 degrees, achieving a total range of motion of 30-35 degrees. Though a human player is capable of serving a ball at more than 30 degrees from the horizontal, maximum distance is attained at approximately 30 degrees and, therefore, angles greater than this are rare in actual play and are generally unintended.

The roll axis determines the axis of rotation of the ball when a non-zero spin component is applied to the trajectory. Zero degrees of the roll axis represents the major horizontal axis of the wheel assembly 64 when it is parallel to the ground. The range of motion of the roll axis is preferably from minus 90 degrees to plus 90 degrees, for a total range of motion of 180 degrees. With the roll axis in the zero degree position, pure side spin (left or right) may be imparted to the ball. With the roll axis in the +90 or −90 degree positions, pure topspin or pure backspin may be imparted to the ball. Roll axis positions in between +/−90 degrees and zero degrees allow for arbitrary combinations of topspin with side spin or backspin with side spin. These spin options are available regardless of the settings of the yaw and elevation axes.

All combinations of these three axes, within their respective maximum ranges, are supported. The unique geometries of the various components of the drive train 52 represent an innovative way to realize this requirement by comparison to typical rotary motion assemblies and components.

In the embodiment with the electronic control system 60, the drive train 52 supports rapid movement within the range described using inexpensive, readily available, and low-power stepper or servo motors and motion control electronics. The roll axis requires not more than 125 oz-in of torque from its input motor in the worst case and less than 70 oz-in in a typical case. The elevation and yaw axes each require no more than 30 oz-in of torque in the worst case. These torque requirements are readily satisfied, for example, by a typical double-stack NEMA size 23 stepper motor for the roll axis and typical double-stack NEMA size 17 stepper motors for the yaw and elevation axes. Assuming a 300 RPM motor speed, the roll axis can move from one extremum to the other in 15 seconds or less, the elevation axis in 22 seconds or less, and the yaw axis in 10 seconds or less. However, typical usage scenarios involve changes from one service to the next of less than half the maximum range of the yaw and roll axes and only small changes to the elevation axis. Stepper motors can commonly be operated at more than 300 RPM when torque is less than their design maximum; therefore, in typical usage, each axis can achieve its intended motion in 7 seconds or less, which is a design objective of the device 50 so as to support continuous training. Testing has shown that training effectiveness is far more sensitive to small changes in elevation than small changes in either of the other two axes, therefore, the resolution of the elevation axis is approximately double that of the other two axes.

To further conserve on power, each of the three axes uses self-locking mechanisms so that the axis motors need only draw power during actual movement. After a desired position has been achieved, no current need be provided through the motor windings to maintain that position.

Main Post Assembly

Figure 11:
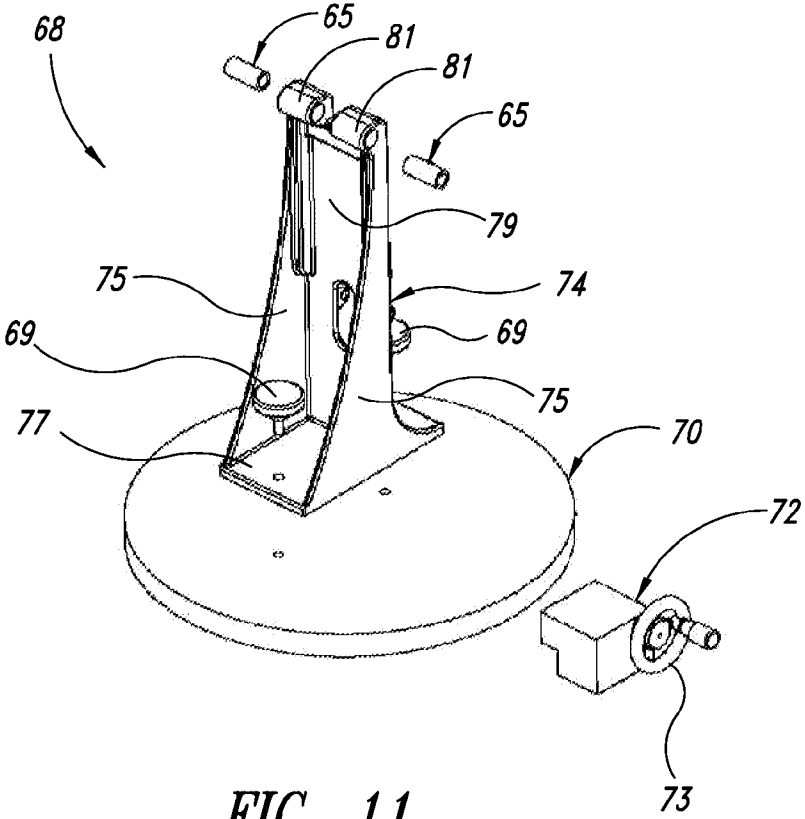
FIGS. 10 and 11 are an isometric view and an exploded isometric view, respectively, of a main post assembly of the present disclosure.
Figure 10:
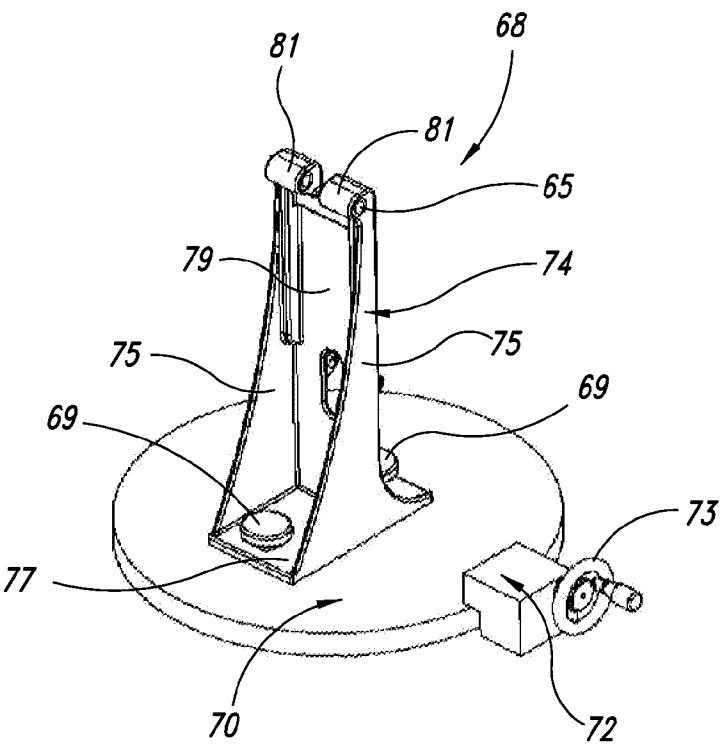

Referring now to FIGS. 10 and 11, the main post assembly 68 comprises a turntable bearing 70, a rotary yaw actuator 72, and a main post 74. The turntable bearing 70 is used to orient the wheel assembly 64 rotationally about an axis perpendicular to the ground. This is referred to as the yaw axis. The rotary yaw actuator 72 determines the angle of rotation of the turntable bearing 70 left or right from an arbitrary center line. In a basic embodiment, a hand wheel or hand crank 73 turns the rotary yaw actuator 72. In a preferred embodiment with an electronic control system 60, the rotary yaw actuator may be turned either by a stepper or servo motor, with a hand wheel or crank available as a manual backup to the stepper or servo motor. In a preferred embodiment, the rotary yaw actuator 72 uses a worm gear with a self-locking thread pitch so that once the desired angular position is reached, the worm gear passively maintains that position, thereby minimizing component count by eliminating the need for a separate locking mechanism and allowing a stepper or servo motor to be powered down after movement so as to conserve battery life. In an alternate embodiment, a linear actuator may be used to implement rotary motion about the yaw axis by mounting its end points at a distance from the axis. Preferably, such a linear actuator would use a self-locking thread pitch.

In a preferred embodiment, the main post assembly 68 can be rotated about the yaw axis through an angle between the left extremum and the right extremum of between 30 and 40 degrees. This range is an optimal tradeoff among three design objectives. First, the need to accelerate the ball principally perpendicular to the base unit's 54 major axis parallel to an axis of rotation of the fixed wheels so as not to cause the base unit 54 to roll to a new position in response to the kickback force. Second, the need to cover those portions of the soccer field required by both typical and advanced training sessions. Third is the added safety of constraining the left/right range of service to only that which is needed for training and no more so as not to accidentally serve in the direction of a player or spectator who is not expecting the ball. This range also permits the use of the alternate embodiment described previously using a linear actuator rather than a worm gear for the yaw rotary actuator.

In the embodiment with the electronic control system 60, the main post assembly 68 includes a sensor at each extremum of the yaw axis. One sensor, the "home" sensor, is located at the minimum-angle position and serves as a home position for calibrating the device's logical position on startup by turning slowly counterclockwise until the home sensor emits an electrical signal. The other sensor, the "end" sensor, is located at the opposite extremum and is used to signal an out-of-bounds error condition.

An alternate embodiment might use a shaft and shaft bearing in place of the turntable bearing. A turntable bearing is preferred, however. The use of a turntable bearing rather than a shaft and shaft bearing(s) spreads kickback forces over a large surface area, thereby reducing costs, reducing mechanical load, and permitting lighter-weight materials to be used. It also allows kickback energy to be partially dissipated by this component, slowly, relative to the time of acceleration of the ball, over a large area of thin plate or casting, so as to minimize displacement of the remainder of the drive train and, therefore, have minimal impact on the flight of the ball. In equivalent alternate embodiments, the turntable bearing may use ball bearings or plain bearings to reduce friction and withstand moment forces.

Figure 13:
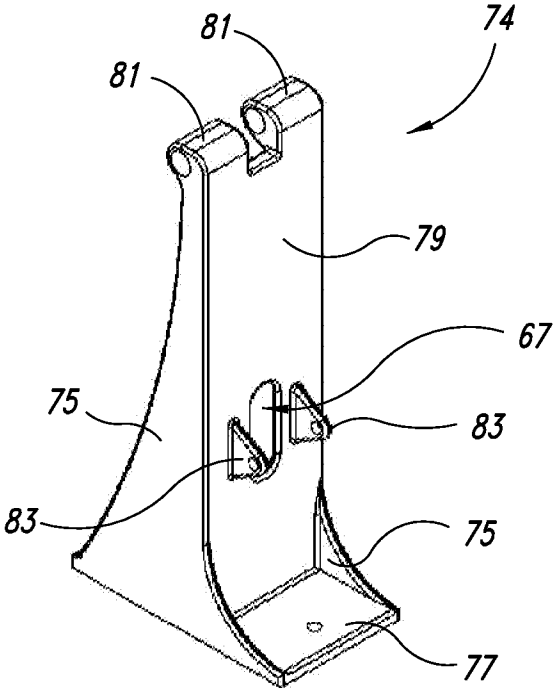
FIGS. 12 and 13 are isometric views of a main post of the present disclosure.
Figure 12:
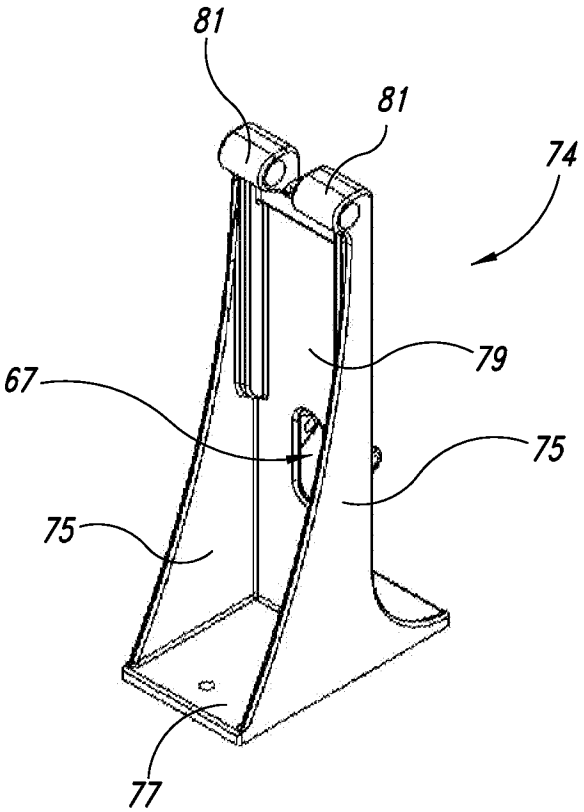

The main post 74, shown in more detail in FIGS. 12 and 13, is of distinctive shape designed to create a unique and attractive appearance for the overall device 50, and to provide stiffness sufficient to not flex more than 0.01 in in any dimension under maximum kickback force while minimizing weight. It is also of such height as to provide clearance for the wheel assembly 64 and no more, thereby minimizing the height of the ball from the ground when released. The main post houses bearings 65 for the elevation shaft 78. It is preferably an aluminum casting. In a preferred embodiment, the bearings 65 for the elevation shaft 78 are plain bearings of lightweight plastic that do not require lubrication and are corrosion-resistant and UV-stable, for example nylon or polytetraflouroethylene (PTFE, commonly known by the trade name Teflon). In a preferred embodiment, the main post 74 is easily attached to and detached from the turntable bearing 70 using threaded fasteners 69, or the turntable bearing 70 is easily attached to and detached from the base unit 54, so as to allow that subset of the drive train including and above the component detached to be laid down in a horizontal position on top of the base unit 54 for transport in a small car trunk, for example that of a Honda Civic.

In a preferred embodiment, the detachable assembly may be mounted, not merely laid, in a horizontal position atop the base unit 54 for transport. The main post 74 includes two substantially planar and mutually opposing parallel sides 75 extending orthogonally from a bottom 77 and joined along their length by an orthogonal web 79. Each side 75 terminates in a cylindrical journal 81 adapted to receive the bearings 65 for the elevation shaft 78. A pair of ears 83 extend from one side of the web 79 in spaced parallel relationship and adapted to mount the elevation assembly 66 thereto. An opening 67 in the web 79 is sized and shaped to allow the elevation assembly 66 to pass there through.

Elevation Assembly

Figure 15:
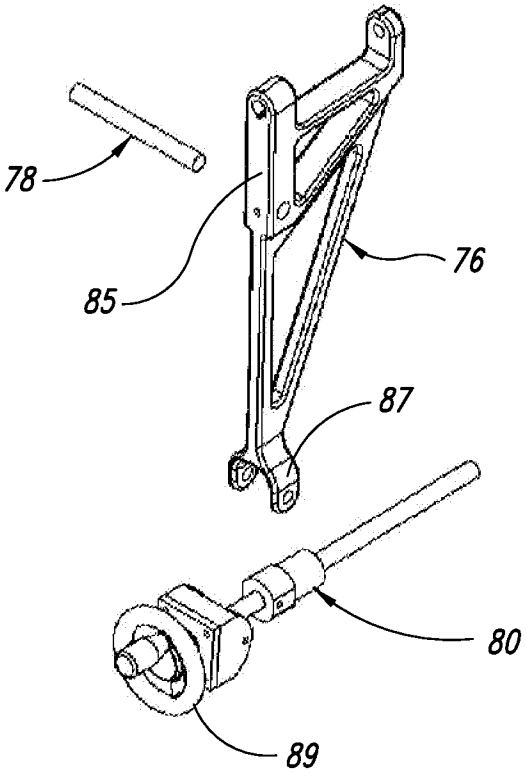
FIGS. 14 and 15 are an isometric view and an exploded isometric view, respectively, of an elevation assembly formed in accordance with the present disclosure.
Figure 14:
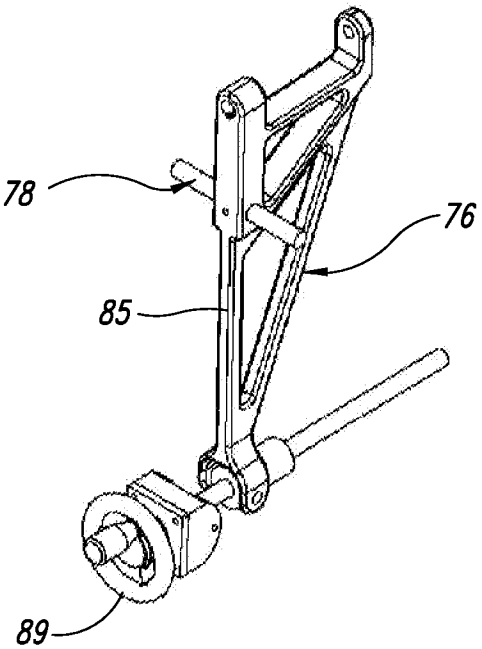

The elevation assembly 66 shown in greater detail in FIGS. 14 and 15 includes an elevation bracket 76, the elevation shaft 78 and a linear actuator 80. The elevation shaft 78 provides for rotation of the wheel assembly 64 about an axis horizontal to the ground and perpendicular to the direction of acceleration of the ball between the tires. This axis is referred to as the elevation axis. When the reference surface (rearmost face) 85 of the elevation bracket 76 is perpendicular to the ground, it is in the zero degree position, with positive angles moving the bottom of the elevation bracket 76 away from the main post 74 and negative angles moving it toward the main post 74. In a preferred embodiment, the elevation assembly 66 provides angles to the vertical ranging from approximately −5 degrees (ball is directed slightly downward) to approximately +30 degrees (ball is directed upward). From the exit point of the device 50 for the ball, −5 degrees downward provides service that approximates a pass from ground level by a human player; beyond approximately −5 degrees the ball bounces more than rolls. Taking into account air friction, the angle of service of a ball that optimizes distance and, therefore, the uppermost angle for routine training of players, is approximately +30 degrees.

The linear actuator 80 determines the angle of the elevation bracket 76 with respect to the main post. In a preferred embodiment, the linear actuator 80 uses a lead screw with a self-locking thread pitch (typically 10 threads per inch) so that once the actuator 80 reaches a desired position, the lead screw passively holds that position, thereby allowing a stepper or servo motor used to turn the lead screw, in a preferred embodiment including an electronic control system 60, to be powered down after movement. In one variation, the linear actuator 80 provides shock-absorbing washers between the lead screw and nut assembly and the remainder of the linear actuator, so as to help dissipate kickback energy when accelerating a ball and dampen oscillation after firing a ball.

In a preferred embodiment, the elevation assembly 66 includes a sensor (not shown) at each extremum of allowable motion, one of which is a home sensor for calibrating position on starting up the device 50, the other an end sensor for signaling an out-of-bounds error condition. An alternate embodiment might use a rotary actuator in place of the linear actuator 80.

The elevation bracket 76 is preferably aluminum and preferably an aluminum casting optimized for the application. In a preferred embodiment, the elevation bracket 76 has a ratio of approximately 1:1 between (1) the distance from the elevation shaft 78 to the attachment point, in this case an attachment yoke 87, of the elevation linear actuator 80 and (2) the distance, on an axis coincident with the reference surface 85 of the elevation bracket 76, from the elevation shaft 78 to the axis of acceleration of the ball between the wheels. A ratio of 1:1 is an optimal tradeoff among design considerations. The higher the ratio, the lower the kickback force transmitted into the elevation linear actuator 80 when a ball is fired. A 1:1 ratio allows the use of a smaller, lighter-weight and higher-precision lead screw than would be required were the ratio less than 1:1. It also allows the use of a plastic nut rather than a metallic nut, with the benefits of lighter weight, higher precision (compared to an acme screw and nut), and more energy absorption. As, for example, a Kerk Motion Products 0.5 in 8000 Series precision lead screw with a matching Kerk Motion Products B Series precision plastic nut. At the same time, there is a need to convert the linear motion of the lead screw nut into rotary motion of up to 35 degrees in a linear distance of approximately 11 inches. This, and the height of the main post, constrain the ratio to be at most 1:1. As shown in FIGS. 14-15, the linear actuator 80 can be manually turned via the hand crank 89.

Wheel Assembly

Figure 16:
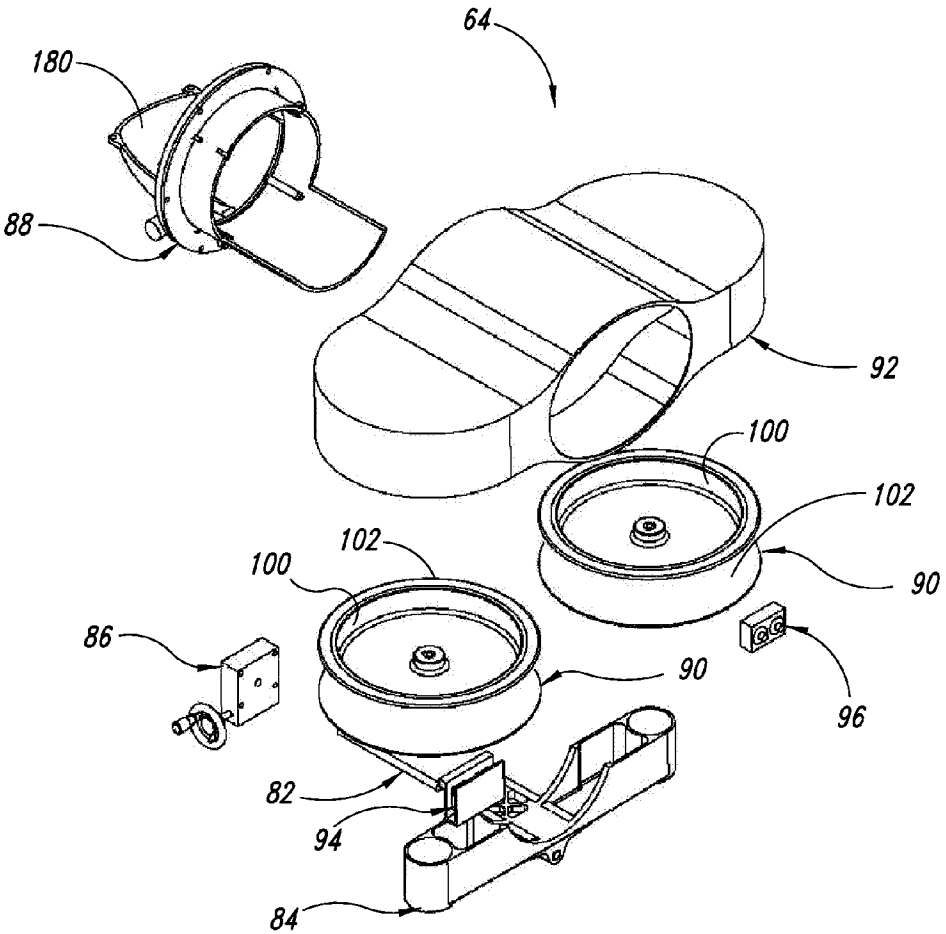
FIG. 16 is an exploded isometric view of a wheel assembly formed in accordance with one embodiment of the present disclosure.
Figure 17:
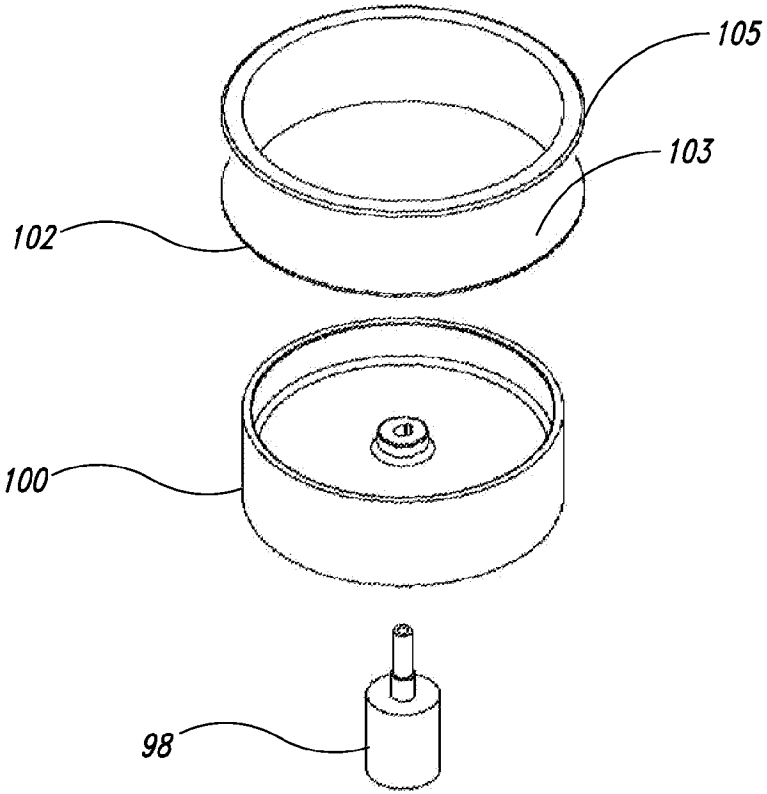
FIG. 17 is an exploded isometric view of a powered wheel formed in accordance with the present disclosure.
Figure 18A:
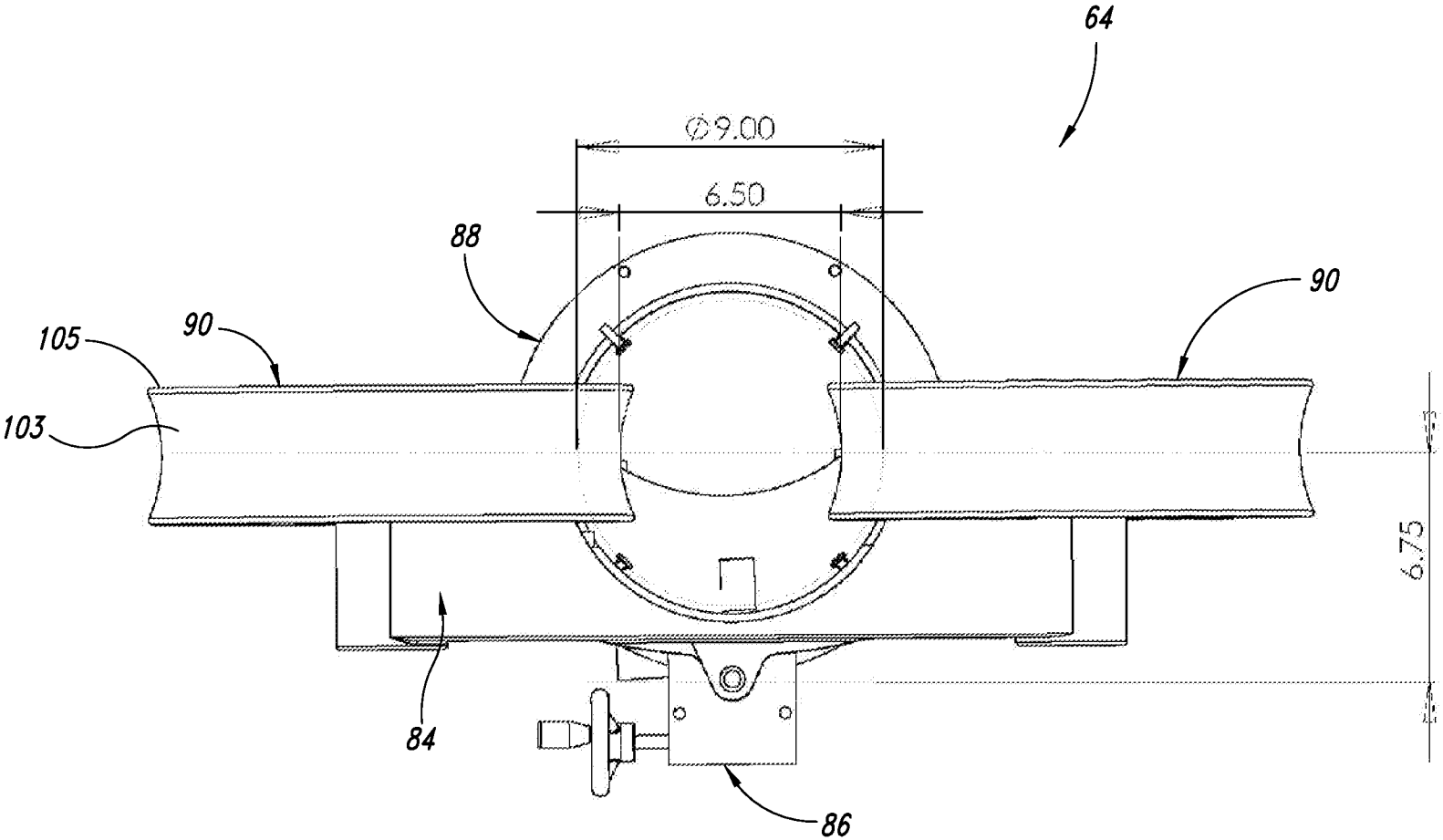
FIG. 18A is a front view of a wheel assembly formed in accordance with one embodiment of the present disclosure.
Figure 18B:
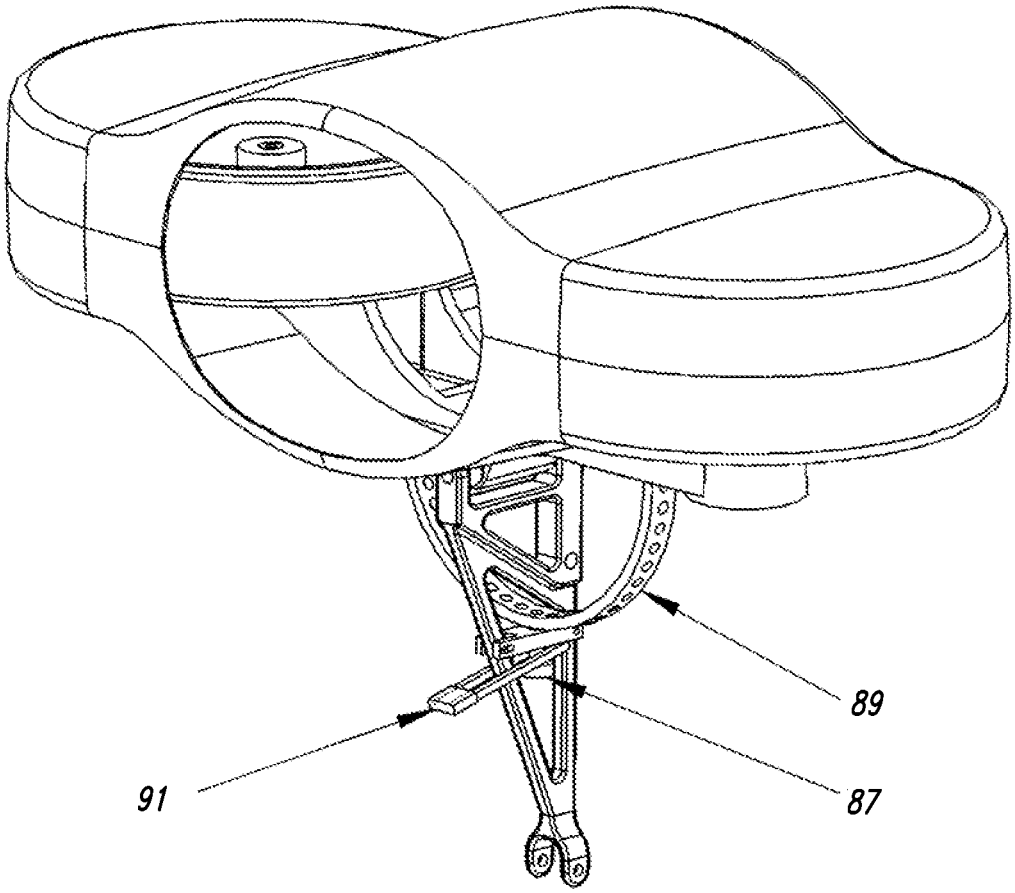
FIG. 18B is an isometric view of an alternative embodiment of a roll rotary activator.

Referring next to FIGS. 16, 17, 18 A-B, 19 and 20 A-D, the wheel assembly 64 generally includes a roll shaft 82 for attaching a wheel spine 84 to the elevation bracket 76, and a roll rotary actuator 86 to provide the means to rotate the wheel spine 84 about an axis perpendicular to the elevation shaft 78 and parallel to the ground when the elevation bracket 76 is in its vertical (zero degree) orientation. In a preferred embodiment, the roll rotary actuator 86 provides rotation through 180 degrees of angle, from the wheel spine 84 oriented parallel to and to the right of the elevation bracket 76 (+90 degrees), through a position of the wheel spine 84 perpendicular to the elevation bracket 76 (0 degrees), to the wheel spine 84 oriented parallel to and to the left of the elevation bracket 76 (−90 degrees), and all positions in between. In one embodiment, the roll rotary actuator 86 uses a worm gear with a self-locking thread pitch so that once a desired roll angle is reached, that position is passively maintained by the roll rotary actuator 86. Referring to FIG. 18B, in an embodiment alternative to the use of a worm gear, the roll rotary actuator uses a spring plunger 87 to lock the angle of roll at the desired position, together with a roll index 89 into which the spring plunger's nose is inserted. A handgrip 91 gives the user a means of retracting the spring plunger, allowing the structure to be rotated about the roll axis by grasping the structure with the other hand. In an embodiment without an electronic control system 60, this alternate embodiment of the roll rotary actuator is considerably less expensive to implement than a worm gear assembly, at the cost of limiting the device to a fixed set of predetermined roll angles. In an embodiment of the device 50 with an electronic control system 60, a less-expensive involute gear or cable drive may be used to position the roll axis using a motor, with an electrically-controlled spring pin (typically a solenoid) taking the place of the manually-operated spring plunger. In a preferred embodiment, the wheel assembly 64 includes a sensor (not shown) at each extremum of allowable motion, at one extremum a home sensor and at the other an end sensor, as previously described with respect to the yaw axis. In an alternate embodiment, a linear actuator may be used in place of the roll rotary actuator 86.

In addition, the wheel assembly 64 generally includes a ball chute 88, two powered wheels 90 with tires 102, a cowling 92, a pair of electronic motor drives 94, and a speed control unit 96. The wheel spine 84 provides a means of attachment for the other components of the wheel assembly 64 while providing a space for a ball to pass between the powered wheels 90.

As shown in FIG. 17, each powered wheel 90 generally comprises a wheel motor 98, a hub 100, a tire 102, and a means to secure the hub 100 to the shaft of the wheel motor 98. The mechanical model implemented is that of flywheels using stored angular kinetic energy to accelerate the ball, losing angular kinetic energy equal to the linear kinetic energy of the ball on exit. The role of the motor 98 is then to restore that amount of energy to the hub 100 and tire 102 over the period of time allowed between ball services. Assuming the mass of the hubs 100 and tires 102 is essentially concentrated at the rim, the angular speed of the hubs 100 and tires 102 decreases by the ratio of the weight of the ball to the combined weight of the hubs 100 and tires 102. For example, if the hubs 100 and tires 102 combined weigh 20 pounds and the soccer ball accelerated by the device 50 weighs approximately 1 pound, the hubs 100 and tires 102 lose approximately 5% (1 lb/20 lb) of their RPMs in accelerating a ball. In a preferred embodiment, the hubs 100 and tires 102 lose no more than 3%-5% of their RPMs in accelerating a ball, and the wheel motors 98 accelerate them back to speed within 7-10 seconds for balls served at up to 30 meters per second. This time interval corresponds to the time typically needed by a player to receive a served ball and act on it, and then prepare for the next service. A shorter time interval requires an unnecessarily high power output from the wheel motors 98 and a longer interval limits training.

In a preferred embodiment, the wheel motor 98 has a shaft and bearings capable of withstanding a radial force exerted by a ball normally to the motor's shaft of approximately 360 pounds, allowing up to 24 square inches of contact between ball and tire with an internal ball pressure of up to 15 pounds per square inch, with deflection of the shaft tip of no more than 0.005 inches from the axis of rotation of the shaft.

Preferably, the tire 102 is made of a non-marking, solid polybutadiene rubber, or a blend with polybutadiene as the major polymer or a blend with styrene butadiene as the major polymer, of approximately 20-30 duro hardness on the Shore A scale, so as to maximize grip on the ball, including wet grip needed for accurate performance with moist balls and to allow the tire to conform to the ball as the ball is compressed out of a round shape while not harming the surface of the ball. In a preferred embodiment, the face 103 of each tire 102 has a concave radius of curvature of between 4.0 and 4.5 inches to approximate the radius of curvature of a typical soccer ball, in between a convex radius of approximately ⅛ inch on each outer edge 105 of the tire 102. The central concave radius in close approximation to the radius of curvature of a soccer ball maximizes the surface area of contact between the tire 102 and the ball upon the initial engagement, thereby maximizing initial grip by the tire 102 of the ball. The small convex radii at the edges 105 minimize tire 102 deformation and stress on the ball as the tire 102 and ball are each compressed. In a preferred embodiment, the diameter of the tire 102 measured at the center of its face 103 is in the range of 13-14 inches, and in one embodiment 13.5 inches.

Referring to FIG. 18, the preferred distance between the centers of the tire faces 103 is approximately 6.5 inches. FIG. 18 shows the relationship between this and a typical 9 inch diameter ball passing between the tires. The combination of this distance between tire faces and the preferred diameter of the tires provides for an acceleration distance of approximately 11 inches from the point of initial contact of ball and tire 102 to the last point of contact of ball and tire 102. This distance corresponds to the distance over which a soccer ball is accelerated by the human foot when kicked, an acceleration distance for which soccer balls are designed to be optimal.

It is also a design tradeoff among the desired attributes of small, lightweight wheels and tires, maximum grip on the ball by the tires, and weight of the hubs and tires combined of approximately 20-30 times the weight of a soccer ball, so as to lose no more than a design objective of 3%-5% (1 pound ball/20-30 pounds of wheel and tire) of the angular kinetic energy of the wheels when accelerating the ball to full speed. In a preferred embodiment, the tire thickness measured at the tire face 103 is approximately 0.5 inches.

In a preferred embodiment, the wheel motor 98 is a brushless motor so as to maximize motor efficiency, therefore minimizing the electrical power required to operate the motor, and minimizing maintenance by virtue of no parts in contact between rotor and stator. In a preferred embodiment, the hub 100 and tire 102 have a combined weight of between 10 and 15 pounds (20-30 pounds for the pair), and in one embodiment the weight is concentrated near or at the rim. An alternate embodiment may use a shaft and bearings to support the hub 100, separate from the wheel motor's shaft and bearings, together with a timing belt, gear mechanism, or coupling to connect the motor shaft to the hub shaft. The preferred embodiment, with a shaft and bearings shared between the wheel motor 98 and the hub 100, by comparison to such an alternate embodiment, has a higher mechanical efficiency than a timing belt or geared designs, thereby minimizing electrical power required to operate the wheel motors 98, reducing the weight of the device 50, and increasing reliability by decreasing the component count.

Ideally, the wheel spine 84 is an aluminum casting of approximately 24 inches in length and weighing 10 pounds or less, and that deflects no more than 0.020 inches from end to end in response to a normal force against each tire 102 of up to 360 pounds, thereby maintaining parallel alignment of the tires when the ball is fully compressed between the tires 102. In a preferred embodiment, the wheel spine 84 provides attachment of the roll rotary actuator 86 at a distance rearward of the elevation bracket 76 sufficient to allow the elevation bracket to be tilted at least 30 degrees from the horizontal without interference from the wheel spine 84 or roll rotary actuator 86 on the one hand and the main post 74 on the other, regardless of roll angle. Preferably, the wheel spine 84 supports the roll shaft 82 at a distance of not more than 6.75 inches from the centerline of the tires 102 so as to minimize the torque about the roll axis. The theoretical minimum for this value is 4.5 inches, the approximate radius of a soccer ball, so this can be restated as the wheel spine 84 supporting the roll shaft 82 at a distance of approximately 2.25 inches from the outer shell of the ball as it passes between the tires.

The pair of electronic motor drives 94 provides control of the rotational speed of the two powered wheels 90. The speed control unit 96 provides an interface for the user to input the desired speed of each wheel 90. The two powered wheels 90 are independently controllable so as to allow the device 50 to impart spin on the ball by causing one wheel to spin faster than the other. In a preferred embodiment, the user may choose a surface speed of each tire 102 ranging from approximately 8.5 meters per second to 30 meters per second, and a difference in surface speed between the two tires 102 corresponding to a spin on the ball ranging from −10 to +10 revolutions per second. In one basic embodiment, the speed control unit 96 consists of one potentiometer for each wheel and a voltage source across the potentiometer, with output voltage from the potentiometer proportional to wheel speed. In an alternate basic embodiment, the speed control unit 96 consists of a keypad for input of the desired speeds and a digital display for visual output of the desired speed. In a preferred embodiment, the motor drives 94 have a serial interface so that they can be controlled by an electronic control system 60. In a preferred embodiment, the user may input the desired forward speed, ranging from approximately 8.5 meters per second to 30 meters per second, and the desired spin, expressed in revolutions per second and ranging from +10 to −10 revolutions per second, and the speed control unit 96 or a processor in the electronic control system 60 or both then automatically calculate from those inputs the tire surface speeds and, by extension, the motor speeds needed to achieve the desired forward velocity and spin.

Figure 19:
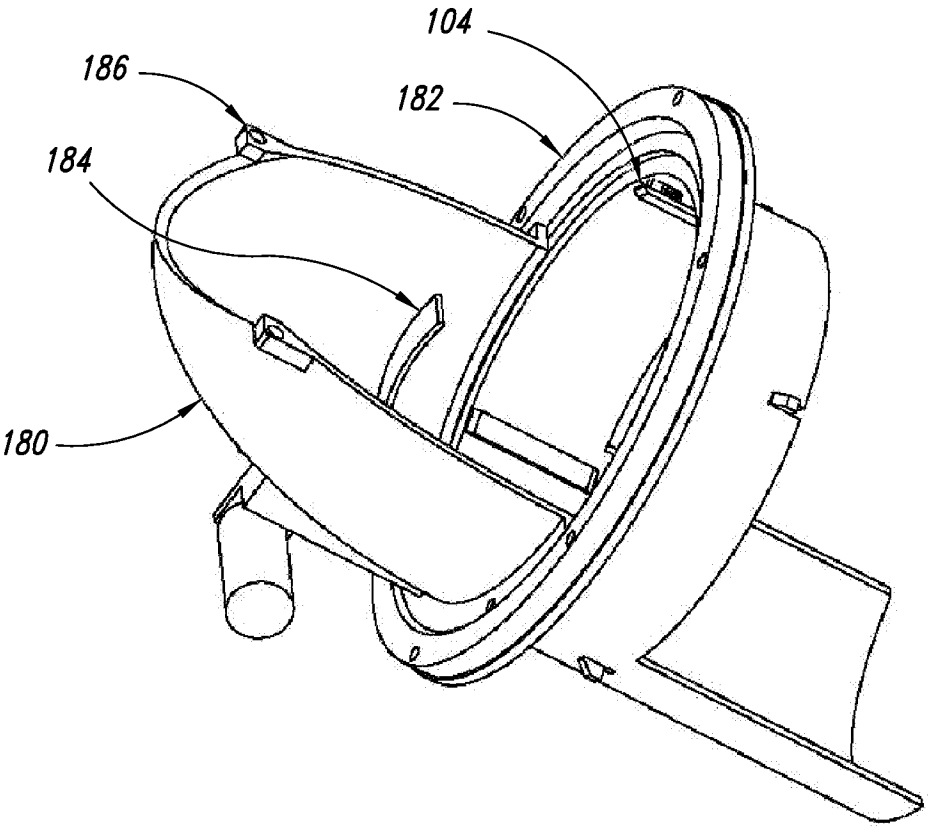
FIG. 19 is an isometric view of a ball chute formed in accordance with the present disclosure.

The ball chute 88, shown in more detail in FIG. 19, generally includes a centering mechanism 104 to ensure that the ball is fed precisely centered between the two tires 102. Consistent, centered ball feed is a critical factor in achieving a high degree of accuracy and repeatability in ball service. In a preferred embodiment, the ball chute 88 provides for automated feeding of the ball in response to an electrical signal that controls a switch, whether local or a wireless remote switch using radio frequency signals, or an electrical signal coupled to the electronic control system 60. This embodiment generally includes a ball scoop 180; a bearing 182 that allows the ball scoop 180 to remain horizontal to the ground as the wheel assembly 64 is rotated about the roll shaft 84; and a ball actuator 184 that pushes the ball from the ball scoop 180 through the remainder of the ball chute 88 in response to one of the electrical signals aforementioned. The ball scoop 180 provides attachment points 186 for a ball ramp 116, shown in FIGS. 21-22. In a preferred embodiment, the ball chute 88 also includes a sensor (not shown) that provides an electrical signal indicating the presence or absence of a ball at the entrance to the ball chute.

Figure 20A:
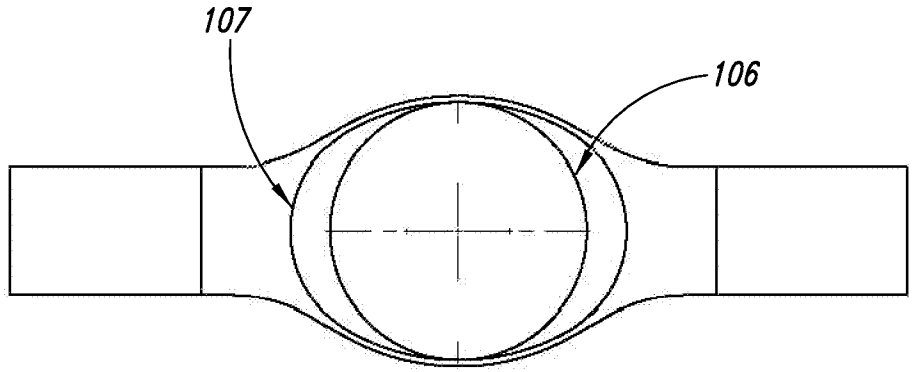
FIG. 20A is a front view of a cowling for a wheel assembly formed in accordance with the present disclosure.
Figure 20B:
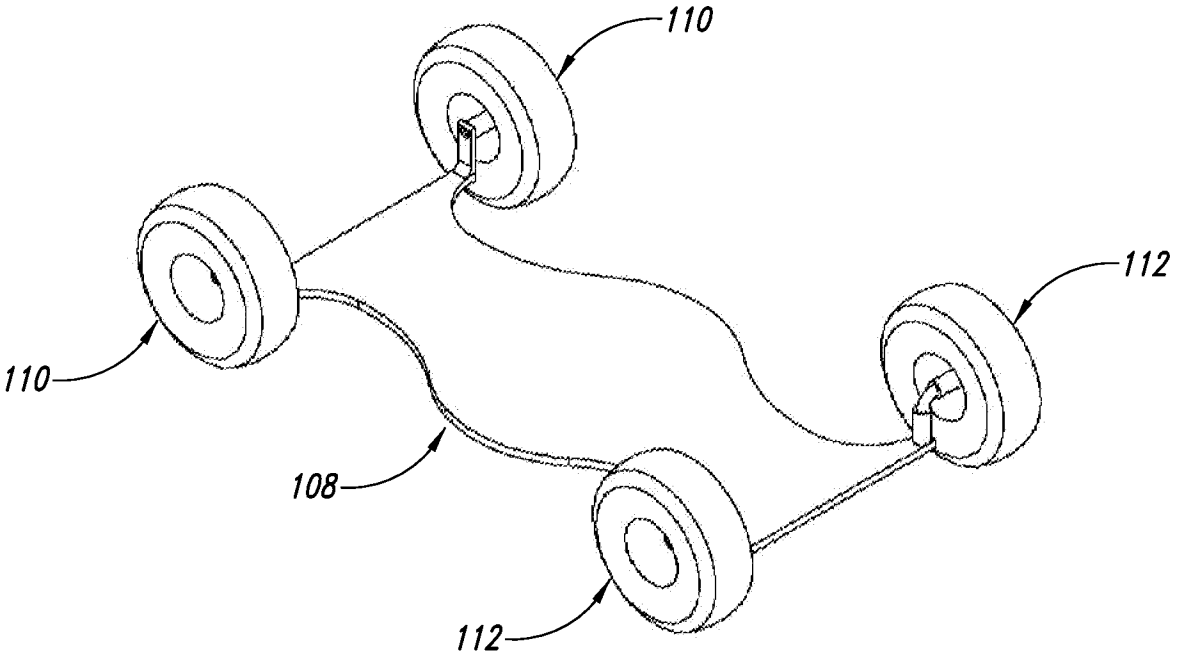
FIG. 20B is an isometric view of a base formed in accordance with one embodiment of the present disclosure.
Figure 20D:
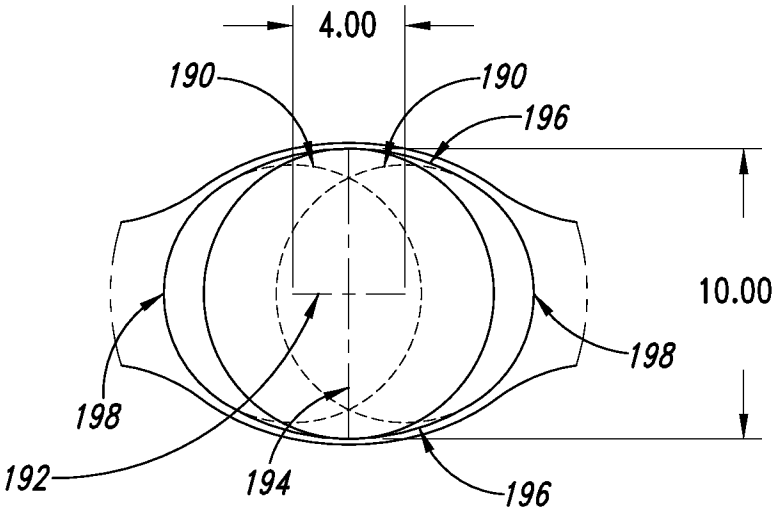
FIGS. 20C and 20D are a front view and enlarged detail view, respectively, of the cowling in accordance with one embodiment of the disclosure.
Figure 20C:
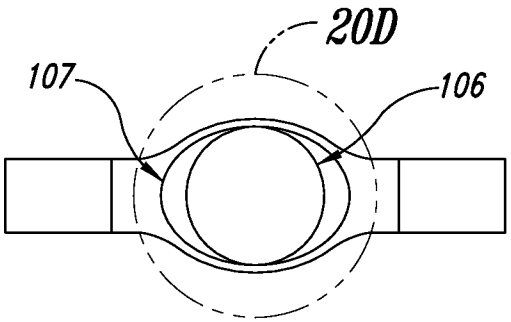

Referring now to FIGS. 20A, 20C, and 20D, the cowling 92, which provides for safety and protection of other components from damage, completely covers the tires except for the cowling entry hole 105 and cowling exit hole 106 that allow the ball to pass there through. The cowling entry hole 105 is circular and large enough to enclose the ball chute 88 and permit passage of a ball to the tires 102. The cowling exit hole 106 is elongated along the axis centered on the tires 102, perpendicular to the path of the ball and parallel to the major axis of the wheel spine 84, so as to allow a ball to remain in contact with one tire 102 longer than the other due to differential tire 102 surface speed and, therefore, exit from the tires at a slight angle. In a preferred embodiment, the elongation is sufficient to allow a spin ranging from +10 to −10 revolutions per second at all forward speeds supported by the device 50.

The shape of the exit hole 106, shown in more detail in FIGS. 20C and 20D, consists of four circular arcs, tangent to one another at their intersections. The four arcs are determined as follows. (1) Two circles 190 the approximate diameter of a soccer ball, or slightly larger, are placed the distance apart that has been empirically determined to allow sufficient room for a ball to exit with maximum spin. (2) A spin line 192 is drawn connecting the centers of those two circles 190. (3) A side clearance line 194 is drawn perpendicular to the spin line 192, with the midpoints of the two lines coincident. The length of the side clearance line 194 is equal to or greater than the diameter of the circles 190 but is otherwise arbitrary. (4) An arc 196 is drawn tangent to each circle, with the arc center coincident with the side clearance line 194, and with the arc 196 coincident with one endpoint of the side clearance line 194. Similarly, another arc 196 is drawn tangent to each circle and coincident with the other endpoint of the side clearance line. These are the top and bottom arcs. (5) An arc 198 is drawn along each circle 190, with endpoints coincident with the top and bottom arcs 196. These are the side arcs. It is to be noted that if the length of the side clearance line 194 equals the diameter of the ball circles 190, the top and bottom arcs are of infinite radius; i.e., straight lines. In the embodiment shown in FIG. 20C, the length of the spin line 192 is 4 inches, allowing up to 2 inches of deflection of the ball on exit in either direction, and the length of the side clearance line 194 is 10 inches so as to match the diameter of the cowling entry hole 105 for reasons of appearance. In one embodiment of the disclosure, a hinged flap covers part of the cowling exit hole and is capable of opening outward but not inward. This flap thereby permits a ball to freely exit the cowling exit hole, but not to enter it. This prevents a ball from accidentally being kicked into the exit hole thereby potentially damaging the device, the ball, or both, and potentially creating a safety hazard. The flap may be passively pushed open by the ball or it may be electrically opened when a ball is served.

Base Unit

The base 54, shown in more detail in FIG. 20B, generally includes an energy-absorbing platform 108, two fixed rear-mounted pneumatic base wheels 110, and two steerable front-mounted pneumatic base wheels 112. In a preferred embodiment, the base 54 also includes support for mounting all or a substantial portion of the drive train 52 in a horizontal position atop the base 54 during transportation and storage of the device 50. In a preferred embodiment, the base 54 also provides support for mounting other components of the device 50 for transport and storage, including, but not limited to, the power unit 56, the ball feed unit 58, and the electronic control unit 60. The energy-absorbing platform 108 absorbs all or a substantial portion of the kickback force generated by the drive train 52 in accelerating a ball so as to not cause, when a ball is accelerated by the drive train 52, the base wheels 110 and 112 to either move or to transmit enough force into the ground to cause damage to the grass, dirt, or artificial surface on which the base wheels 110 and 112 rest. Energy is absorbed through flexing of the platform 108 and flexing of the pneumatic tires of the base wheels 110 and 112, in response to the kickback force. In an alternate embodiment, energy is also absorbed by energy-absorbing bumpers at connection points between the turntable bearing 70 and the platform 108, between the platform 108 and the axles of the base wheels 110 and 112, or both. The energy-absorbing platform 108 is also of distinctive shape designed to create a unique, ornamental, and attractive appearance for the device 50.

In a preferred embodiment, all or a substantial portion of the drive train 52 may be detached from the base unit 54, and fastened in a horizontal position atop the base unit 52 for ease of transportation, as for example in the trunk of a car.

Power Source

The power source 56 provides approximately 24 volts DC to the powered components of the device 50. In a preferred embodiment, power is provided by a rechargeable battery pack capable of supporting operation of the device 50 for a minimum of three continuous hours without recharging, such as, for example, two deep-cycle absorbed glass mat (AGM) batteries, including Lifeline model GPL-U1T batteries, or two deep cycle lithium ion batteries, such as Valence Technologies model U1-12RT. In a battery-based preferred embodiment of a power source 56, the power source 56 also includes means for monitoring the state of discharge of the batteries. Ideally the power source 56 also includes means for providing power usage data to an electronic control system 60. Preferably, all components continue to operate with full performance on batteries whose output voltage ranges from fully charged 13.2V to a partially discharged 10V. In an alternate embodiment, the power source 56 converts household alternating current power of approximately 110V or 220V to 24V DC power. In an alternate embodiment, a higher or lower DC voltage is supplied by the power source 56 and consumed by the device 50, for example 36V or 12V.

Ball Feed Unit

The ball feed unit 58 shown in detail in FIGS. 21A and 22 generally includes a ball hopper 114 and a ball ramp 116. In a preferred embodiment, the ball feed unit 58 also includes a ball elevator 118, and a ball collector 120. The ball hopper 114 can store up to approximately 12-16 soccer balls at a time, corresponding to a typical number of balls brought by a coach to a team practice, and the ball hopper 114 can be easily collapsed on its vertical axis for convenient transportation and storage, then extended for operation. Balls are arranged in the ball hopper 114 such that gravity presents one ball at a time at the ball ramp 116. An electrically activated gate prevents a ball from leaving the ball hopper 114 and entering the ball ramp 116 until an electrical signal is received from a sensor on the ball chute 88 indicating that no ball is at the entrance of the ball chute 88, or, in a preferred embodiment, a signal is received from an electronic control system 60.

The ball hopper 114 stores the balls at a height sufficient to allow the ball to roll down the ball ramp 116 under the force of gravity, approximately 24-36 inches vertically from the ground. The ball elevator utilizes a ball sensor that detects the presence of a ball on the elevator plate 126 and causes an elevator actuator 128 to lift the ball and deposit it into the ball hopper 114, then return to ground level. The ball collector 120 may have several embodiments, all of which cause soccer balls to roll one at a time on to the elevator plate, thereby returning them to the ball hopper 114.

One embodiment of a ball collector 120 is shown in FIG. 22, where a ramp 130 is placed at the base of a soccer training net, but any shape that causes balls to roll onto the elevator plate 126 may be used, including circular embodiments.

FIG. 21B shows another embodiment incorporating a ground-based ball hopper 115 that has the advantage of not toppling over when hit by a soccer ball or other object. Balls are fed from the hopper 115 to the opening in a flexible duct or feed tube 117 sized and shaped to accept the soccer ball. Ideally, the duct 117 has a 10 inch diameter.

Electronic Control System

The electronic control system 60 is shown generally in FIG. 23. The electronic control system 60 generally comprises a microcontroller 134, such as the Coyote embedded controller manufactured by Z-World, positioning motors 136, 138, 140 for the yaw axis, elevation axis, and roll axis, software programs, stored data, a user interface 142, one or more sensors, and electrical interfaces. In the following discussion, "program" may refer to either a stand-alone software program or equivalent subroutine within a larger program. The choice between the two does not affect the overall design or function of the device 50.

Positioning Motors

The positioning motors 136, 138, and 140 are typically stepper motors used to power the yaw rotary actuator 72, the elevation linear actuator 80, and the roll rotary actuator 86, respectively, under the control of the microcontroller 134 and its software programs. In an alternate embodiment, any or all of the positioning motors 136, 138, and 140 may be servo motors with encoders. In the alternate embodiment of the roll rotary actuator using a spring plunger 87 and roll index 89 as shown in FIG. 18B, the electronic control system also includes a solenoid in place of the spring plunger 87, so that the roll index may be unlocked prior to movement of the roll axis. The solenoid is controlled by the microcontroller 134 to coordinate unlocking, movement using the roll axis positioning motor, and then relocking the roll axis.

Trajectory Program

A trajectory program stored in the microcontroller 134 takes as input the desired angles of yaw, elevation and roll, and causes the positioning motors 136, 138 and 140 to move to positions such that the desired trajectory is achieved. The desired trajectory may be input from a stored training program or inputted by the user through the user interface 142, such as a keyboard, touch screen, and the like. In a preferred embodiment, for each axis there is a home switch (a specific instance of a sensor) used by the trajectory program to calibrate the position of the drive train 52 on each of the three polar axes on power up of the device 50, periodically, when asked by the user through the user interface 142, or on any error condition indicating a possible positioning error. The home position is determined by slowly rotating the axis in the direction of home until a home sensor or the home switch is tripped, then reversing until the home sensor is cleared.

Velocity Program

The velocity program is a specific embodiment within the electronic control system 60 of the concept of a speed control unit 96. In a basic embodiment, it takes as input the speeds desired for each of the two powered wheels 90. In a preferred embodiment, the velocity program takes as input the desired exit velocity and spin to be imparted to the ball, computes the angular velocity in revolutions per minute for each powered wheel 90 needed to implement that velocity and spin. In either case, through a serial interface for each electronic motor drive 94, the velocity program directs the electronic motor drives 94 to attain and then maintain those wheel angular velocities in the powered wheels 90. Inputs that specify the desired velocity and spin may come from a stored training program or from the user through the user interface unit 142.

Safety Program

The safety program takes as input readings from various sensors and determines whether the device 50 is in a safe operating condition. If not, the safety program initiates a powered shutdown of the wheels 90. In one embodiment, the safety sensors include a tilt switch to detect when the main post 74 is not in a vertical orientation; an assembly switch to detect when the drive train is locked in its operational position on the base unit 54, as opposed to its transport position; an interference sensor, such as an ultrasonic range finder, that indicates an obstruction, possibly a person, within approximately 5 yards of the exit point of the ball from the device 50; a voltage sensor to detect when the power source 56 is providing voltage below the operating requirements of the device 50; and, one or more temperature sensors to detect when temperature-sensitive components are operating within their design limits for high and low temperature.

Stored Training Programs

Stored training programs will now be discussed in detail in conjunction with FIGS. 25 and 26. The microcontroller 134 may store an arbitrary number of stored training programs up to the limit of its memory capacity. Each stored training program comprises a service set 148 and an instruction sequence 150. Each ball service of which the device 50 is capable may be completely specified by a combination of five values: a ball velocity, a ball spin, and an angular position for each of the yaw, elevation and roll axes. A combination of one value for each of these five attributes is called a ball service specification 152. In one embodiment, user-recognizable names may be assigned to ball service specifications 152, and those names may be used instead of numeric identifiers to refer to their corresponding ball service specifications 152 within instruction sequences 150.

A service set 148 is an unordered set of ball service specifications 152. An instruction sequence 150 is an ordered, numbered sequence of instructions 154. Each instruction 154 is either a ball service specification 152 chosen from the service set 148, which is interpreted as a request to serve a ball according to that specification, or a time interval to be observed before executing the next instruction 154 in the sequence 150. A stored training executive program executes stored training programs. When a stored training program is executed by a stored training executive, each instruction 154 is executed in order of its number in the instruction sequence 150, lowest to highest, by sending appropriate instructions to other programs and components. In a preferred embodiment, the instruction set supported by the stored training executive program includes, in addition to the two instructions aforementioned, iteration, conditional execution, and randomness.

In one embodiment, as illustrated in FIG. 26, randomness may be specified in either or both of two ways: (1) each of the five values in a ball service specification 152 is replaced by two values, a minimum and a maximum, allowing the stored training executive to randomly choose from within the ranges specified and (2) an instruction may be any subset of the full service set 148 (rather than only a single member of the service set 148), allowing the stored training executive to randomly choose any ball service specification 152 from that subset.

User Interface Program and User Interface Unit

The user interface program interacts with a user interface unit 142, taking input from the user interface unit 142 and providing output to the user interface unit 142. In a preferred embodiment, the user interface program provides one or more web pages to the user interface unit 142 for execution within a standard web browser such as Microsoft Internet Explorer without the need for custom software for the user interface unit 142. In a preferred embodiment, the user interface unit 142 is a portable computer, such as a laptop computer, a Pocket PC, or a Palm Pilot. In a preferred embodiment, communication between the microcontroller 134 and the user interface unit 142 uses TCP/IP protocol and the IEEE 802.11 (a, b, or g) wireless communication standard, allowing off-the-shelf portable computers supporting the selected wireless standard and a web browser to be used as the user interface unit 142 without custom programming of the user interface unit 142. In an alternate embodiment, a different wireless communication protocol may be used in place of 802.11, such as Bluetooth or ZigBee. In one embodiment, the power source 56 provides power to a docking station for recharging the batteries of the user interface unit 142.

The user interface program and user interface unit 142 provide the user with the means to (1) directly control the five variables that determine trajectory: velocity, spin, yaw, elevation, and roll; (2) serve a ball; (3) choose a stored training program from among those in the microcontroller 134 and initiate, stop or suspend execution of that stored training program; and (4) create, edit, store and delete stored training programs. In a preferred embodiment, the user interface program and user interface unit 142 also permit password-protected establishment of a maximum ball velocity. Examples of the use of this feature include, but are not limited to, a parent of a young player limiting the speeds at which balls may be served to the player or a soccer facility limiting the speeds at which balls may be served to users of the device 50 at their facility. In a preferred embodiment, stored training programs may be transferred in either direction between the user interface unit 142 and an internet web site designed for this purpose, and in either direction between the user interface unit 142 and the microcontroller 134.

Targets

Targets are discussed in detail in conjunction with FIG. 24. A target is anything the user attempts to strike with the ball following service of the ball by the device 50, whether the attempt is made with the first contact with the ball or a subsequent contact with the ball.

In one embodiment, a target either incorporates a ball collector 120, or it is designed such that balls that strike the target will generally be collected by a ball collector 120. In either case, the ball is thereby automatically returned to the ball hopper 114 of the device 50.

A target zone 144 is a portion of a target distinct from the remainder of the target. Each target zone may be, for example, a component, a surface, or a visually distinct portion of the target. A player's objective in playing the ball is to strike some target zone. A target may contain one or more target zones.

In one embodiment, the device 50 is used in conjunction with one or more targets.

A target zone can contain a target sensor to detect when the ball strikes the target zone and a target hit indicator 146 to indicate to the user that the target zone has been hit by the ball. By way of example, a feedback mechanism may generate light or sound.

In one embodiment, a target sensor can detect the force with which the ball strikes the target zone and incorporate that information into the feedback provided to the user, such as in the form of a speed indication. A sensor that detects only whether contact has been made is binary; a sensor that detects the force of contact is force-sensing.

Ideally, a target zone incorporates a target indicator 146 that identifies one target zone from among many as the objective for the player. By way of example, a target indicator may be a light or a sound. Typically, a target hit indicator 146 will double as a target indicator. The target indicator 146 may be controlled by an electronic control system 60.

In addition, the target sensor can provide its feedback in the form of an electrical signal usable by a device 50 equipped with an electronic control system 60.

A smart target is a target each of whose zones has a target sensor, whether binary or force-sensing, capable of providing its feedback as an electrical signal suitable for use by an electronic control system 60. In one embodiment of a smart target, each zone also incorporates a target indicator capable of being controlled by an electronic control system 60.

In a device 50 with an electronic control system 60 and one or more smart targets, the electronic control system 60 is capable of recording and subsequently making available to the player or a human evaluator or trainer the following information for each ball served by the device 50: (1) the target zone, if any, struck by the ball; (2) if the target zone is equipped with a force sensor, the force with which the ball struck the target zone, which can be used to determine the speed of the ball; and (3) the time between ball service and the moment of contact of ball on target zone. In a further embodiment, the electronic control system 60 is capable of assigning a score corresponding to the feedback from the target sensors and recorded time intervals, then providing that score to the player or a human evaluator or trainer.

In another embodiment of an electronic control system 60 used in conjunction with one or more smart targets, stored training programs may incorporate the ability to activate for each ball service one or more target indicators to tell the player which target zone(s) are to be struck by the ball. If more than one target indicator is activated, the player may choose from among them.

Method of Use: Assessment and Training

The device 50 that includes an electronic control system 60 enables a method of training not practical without such a device. The method has the attributes of objectivity and internal and external validity. The method of training generally includes a matrix of skills, a method of assessment, a method of curriculum selection, and a method of implementing the selected curriculum.

Basic Terminology

The method will be discussed in more detail in conjunction with FIGS. 27, 28, and 29.

The described method of training begins with two kinds of variables: service variables 156 and player variables 158. Service variables 156 describe the trajectory and manner in which the ball is served to a player being assessed or trained. Player variables 158 describe the action or actions taken by the player in response to the service.

In an embodiment specific to the sport of soccer, service variables 156 generally comprise the five components of ball trajectory: (1) ball velocity, (2) ball spin, (3) yaw angle, (5) elevation angle, and (5) roll (or spin) angle. In one embodiment of the method, time intervals and semi-random service within defined boundaries provide additional service variables 156.

In an embodiment specific to the sport of soccer, player variables 158 generally describe the player's starting position and motion relative to the point of service of the ball, the body surface or surfaces used to contact the ball, and the action or actions taken by the player with the ball, including a direction or location to which the ball is to be directed by the player. Player variables 158 may describe a single action carried out with a single touch (contact) with the ball, or a series of actions carried out by a series of touches on the ball.

A training domain 160 is a set of service variables together with a set of player variables. This may be visualized as a tabular form with one empty column for each service variable 156 and one empty column for each player variable 158 in the training domain 160. Variable names act as column headings.

A training skill 162 is one value for each variable of a given training domain. Conceptually, a training skill 162 is a row comprising one value in each column, within the table represented by the training domain 160.

A training skill set 164 is a set of training skills 162, whether from one or multiple training domains 160. In the simplest case, a training skill set consists of a set of training skills 162, all from the same training domain 160. As shown in FIG. 27, this may be visualized as a table whose column headings represent the variables in the training domain 160 and whose rows collectively represent the training skill set. However, a training skill set is not constrained to have all of its rows derive from a single training domain 160. It may contain rows (training skills 162) from multiple tables (training domains 160), each table of which has a distinct set of column headings (variables). This is illustrated in FIG. 28, which shows a training skill set comprising skills requiring delivering the ball with the first touch, together with skills requiring controlling the ball with the chest on the first touch, followed by delivering the ball with the second touch. The extra column in the 2-touch table specifies the body surface to be used with the first touch.

As shown in FIG. 29, within a training skill set, each training skill 162 is assigned a training level 166, with all training skills 162 in a given training level deemed comparable in the player proficiency needed to carry out the training skills 162. Each training level is identified by its rank or difficulty relative to other levels; the training level that contains the simplest skills has the lowest rank, on up to the training level that contains the most advanced skills and has, therefore, the highest rank.

A set of training levels ranked in this way is a training curriculum. A training curriculum is the basic structure used for both assessment and training of players. The objective of assessment is to evaluate what rank, or training level, corresponds to a player's current proficiency, and the objective of training is to advance the player's proficiency to that which corresponds to the next-higher training level.

A player's internal rank is the lowest training level for which the player has mastery of all training skills embodied within that training level. An internal rank is specific to one training curriculum.

A player's external rank is a measure of the player's level of proficiency in actual play. By way of example, a set of players may be ranked according to the level of the league in which they are enrolled: division 1 players are in the top rank, division 2 players in the next rank, and so on down to players participating in recreational leagues who are in the lowest rank. Alternative methods of ranking players are readily available, such as the assessment of a panel of expert coaches based on observation of the individual players.

A training curriculum is said to be externally valid if there is a strong correlation between player internal ranks (relative to that training curriculum) and their external ranks, measured across a large number of players.

A good analogy for training curricula and their training levels is to grades in a school curriculum; the higher the grade, the more advanced the topics and skills assessed through testing, the more advanced the material taught, and the more proficient the student becomes at solving real-world problems using that material.

Examples of Variables and Variable Values

By way of example, a set of player variables to describe a player passing the ball to a hypothetical teammate with the first touch on the ball might be comprised of (1) a starting position for the player relative to the point of service of the ball and the direction of service (angle and distance); (2) the position to which the player moves and at which the player first touches the ball following service (angle and distance); (3) a time interval in which to move from the starting point to the point of first touch, with speed of movement implied by the distance between the starting and ending points, divided by the time interval; (4) the body surface used to contact the ball, for example the instep of the right foot; and (5) the location to which the ball is to be directed with the first touch, the location of the hypothetical teammate. More complex examples may involve body surfaces, actions, and player movements for two or more successive touches of the ball.

For a field player (a player other than the goalkeeper and, therefore, not allowed the use of the hands and arms), a body surface variable may potentially take on any of the following 21 values, however encoded: (1-12) any of the six primary surfaces of either foot; (13-14) the thigh of either leg; (15) the chest; (16-17) either shoulder; (18-21) any of four primary playing surfaces of the head: forehead, top, left-top and right-top. For a goalkeeper, a body surface variable may take on all field player body surface values plus (22-24) either or both open hands; (25-27) either or both fists; and (28-29) either shin.

For a field player, an action variable may potentially take on any of the following values, however encoded, representing a single action on the ball with a single touch: (1) control the ball for a subsequent touch by the same player; (2) pass the ball to a (real or hypothetical) teammate; (3) shoot the ball (direct it toward the goal in an attempt to score); or (4) clear the ball away from opponents who are in a position to either shoot on goal or set up a goal-scoring chance. For a goalkeeper, an action variable may potentially take on any of the field player values, plus (5) collect (catch) the ball with the hands; (6) parry the ball upward or downward so as to collect it in two touches; (7) parry the ball with the hands over the top of the goal or to the side of the goal; or (8) parry the ball with the hands away from opponents who are in a position to either shoot on goal or set up a goal-scoring chance.

Overview of the Method

The present method generally comprises (1) a method of constructing externally valid training curricula for a ball sport such as soccer; (2) a method of applying training curricula to the assessment of a player's proficiency and individualized training needs; (3) a method of designing or selecting an individualized training program based on that assessment; and (4) a method of implementing the training program selected. As compared to conventional methods of training, the method described here is externally valid, internally valid, reliable, and highly scalable.

The device 50, particularly in embodiments that include semi-randomness, smart targets, and ball collectors, is specifically designed to be optimal for implementation of the method. However, the method may be implemented using a different ball-serving device with a subset of the capabilities of the device 50. A device capable of supporting the method must have, at a minimum, (1) the ability to accurately and repeatably serve a variety of ball trajectories, (2) the capability to store a plurality of balls and the capability to automatically feed those balls into the device for service, and (3) programmability allowing for stored training programs or their equivalent. This is a subset of the capabilities of the present device 50. A ball-serving device, other than the device 50, with at least these capabilities will hereinafter be referred to as a "comparably capable device."

The method would work with a device, for example, that uses 120V AC power, is not portable, and has a different gimbal arrangement. The requirements are that the device (1) produce a range of ball service vectors and speeds (though not necessarily as wide a range as this device does), (2) have the equivalent of this device's stored training program capability, (3) have an automated ball hopper and ball feed. Preferred embodiments would further include (4) the range of trajectories and spins of which this device is capable, (5) capability to work with target nets to automatically keep score and (6) in a preferred embodiment work with a ball return system to automatically return balls to the hopper. While several embodiments of the disclosure meet those requirements, they also have additional characteristics that are not strict requirements to support the method: portability, battery power, the particular gimbal arrangement and its full range of motion, and energy absorption so it doesn't have to be anchored. For example, a 500 lb stationary unit anchored to concrete in an indoor facility, able to serve only at lower speeds, with less spin, and over a narrower range of exit vectors could still support the method of the present disclosure if it had the listed characteristics above.

External validity of the method of training means that assessments correlate to actual playing proficiency prior to training under the method, and that training under the method results in higher actual playing proficiency. A necessary condition in order to demonstrate that a method of training is externally valid is that a statistically valid sample size be used to gather normative data as part of the construction of the method. It is also necessary to have quantifiable and repeatable outcomes so that tests performed with one player are reliable and may be validly correlated to tests performed with another player. This, in turn, requires highly efficient, accurate and repeatable service of the ball, requirements that can only, within reason, be satisfied by the use of a device 50 or a comparably capable ball-serving device.

Internal validity of assessment and training implies several kinds of consistency. Two comparably proficient players undergoing an assessment should receive similar assessments. A player assessed twice, with no additional training in between, should receive a similar assessment in each case; differences should be due to the training effect of the test itself and not inherent inaccuracies in the assessment method. Two assessors should reach the same assessment of a given player. These conditions require a level of consistency in setup and ball service that can only be provided by a device 50 or a comparably capable ball-serving device.

Scalability is achieved by, to the maximum extent possible, replacing individual judgment of a player's ability with quantifiable, valid, and repeatable methods. The method can thus be readily transferred, through training of assessors and trainers and through the use of like equipment, to an arbitrary number of assessors and trainers. Scaling the use of the method does not depend, in particular, on the availability or lack thereof of skilled human players to serve the ball.

For all of these reasons—external validity, internal validity, and scalability—the method described depends on the use of a device 50 or a comparably capable device.

Construction of Training Curriculum

Construction of an externally valid training curriculum generally proceeds as follows:

1. Select a proposed training skill set 164 based on generally accepted principles of expert coaches as to skills required for proficient play, encoded in the form described for variables, training skill sets, and training curricula.
2. Select a sufficiently large sample of players of known external ranks
3. Collect normative data. Have the players test, with the device 50 or a comparably capable device, the various training skills 162 of the training skill set and record their success or failure with each skill.
4. Correlate success or failure during testing of each player and each training skill 162 with the known external rank of players being tested. Drop from the curriculum any training skills 162 that do not correlate or only weakly correlate to external rank.
5. Use those correlations to group the remaining training skills 162 into training levels, thereby creating a training curriculum.
6. For each training level, identify a subset of training skills that are the most highly correlated to that level. These are the marker training skills, or simply, markers, for the training level.
7. Confirm the model by assessing a separate sample of players of known external rank according to the training curriculum, then correlating the assessed internal rank to the players' known external ranks.

Assessment

Assessment proceeds in two phases. In phase 1, the player being assessed is tested against marker training skills in order to quickly converge on a presumptive training level based solely on markers. In phase 2, all training skills of that training level are tested. If any deficiencies are noted, this phase is repeated for the next-lower training level. If no deficiencies are noted, this phase is repeated for the next-higher training level. This process is repeated until a training level is reached at which the player being assessed is able to successfully complete all training skills, but beyond which the player is unsuccessful at some or all training skills of the next-higher training level.

Individualized Training Program

From the assessment step, the set of training skills at the next-higher training level for which the player does not successfully test is the curricular training set. An individualized training program is directly derived from the curricular training set. Specifically, the training skills to be taught, practiced, and mastered are those in the curricular training set. Conceptually, what is to be taught are those training skills that separate the player from being assessed as belonging to the next training level. In this way, a player is systematically moved upward one rank at a time from the initially assessed internal rank.

In a preferred embodiment with a device 50 and an electronic control system 60, one or more stored training programs are selected, modified, or created for the player being trained to encapsulate and repeat that player's curricular training set.

Implementation of Training

Implementation consists of both instruction in and repetition of the skills from the curricular training set, as well as reinforcement through practice of already-mastered skills, using the device 50 or a comparably capable device, technical instruction from a trainer, and in a preferred embodiment audio-visual training materials. As new skills are mastered they are removed from the curricular training set until that set is empty. At that time, a new assessment is performed to confirm the new, one level higher internal rank of the player, then the curricular training set is moved to skill deficiencies of the rank one higher than the player's new rank, and the process repeats.

In a preferred embodiment with a device 50 and an electronic control system 60, one or more stored training programs are used to automate training in the curricular training set as well as reinforcement of already-mastered training skills.

Extended Method: Sequences of Ball Service as Skills

In an extended embodiment of the method, a programmed training skill is any sequence of training skills of which the ball service components may be represented as a stored training program. Programmed training skills (sequences) may be substituted anywhere a training skill 162 (single skill) is used in the method described, including correlation of programmed training skills to known external ranks of players. The basic embodiment previously described is based on single services of the ball; this extended embodiment permits the inclusion in assessment and training of the ability of a player to quickly move from one ball service to the next. By way of example, a player may be tested in her ability to receive a ball with the right foot and direct it on the first touch to one target, then in a defined interval of time move to a different position and receive a ball with the left foot and direct it on the first touch toward a different target area. The ability to follow one skill with another is part of what defines the proficiency of the player, as opposed to evaluating or training each skill separately.

Extended Method: Use of "Smart Targets"

In a preferred embodiment of the method described, a device 50 equipped with an electronic control system 60 is used in conjunction with one or more smart targets to automate the keeping of score for players being assessed or trained.

Entertainment System

Computer games are extremely popular, especially among ages typically associated with youth soccer training and competition. Such games typically comprise a sequence of levels of increasing difficulty, an objective to be met at each level in order to proceed to the next level, and automated scorekeeping. Users compete against the game program, but also with compete against one another on the basis of score and level attained.

With a suitable embodiment, a device 50 enables an innovative method of soccer training analogous to video or computer games. For the device 50, this preferred embodiment comprises the following: (1) a device 50, (2) an electronic control system 60, (3) a ball feed unit 56, (4) one or more smart targets, and (5) one or more stored game programs. A stored game program is a specialized form of stored training program, directly analogous to computer games: levels of difficulty, objectives for each level, and automated scorekeeping.

Stored game programs are implemented using an expansion to the instruction set supported for stored training programs. Specifically, in a stored game program, (1) each instruction may have associated with it a score to be earned by the player who completes the instruction successfully by striking one of the target zones of the instruction with the required ball speed and within an allowable time; (2) stored game programs may be organized into an ordered sequence of level subprograms, with each subprogram defining one level of play; (3) each level subprogram has associated with it conditions under which the game terminates with failure, for example a maximum number of missed shots by the player; and (4) each level subprogram has associated with it conditions under which the level terminates with success, for example, a cumulative score achieved at that level or the requirement that all ball-service instructions of the level must be completed successfully by the user. A typical embodiment will also include a means to display scores and levels to the player during play, and the means to keep track of the high score achieved by all users of the game.

This preferred embodiment and method increases the appeal of skills training for players, providing entertainment, innovative forms of competition, and training.

FIGS. 30-36 are an isometric view, left side view, right side view, bottom plan view, front elevational view, top plan view, and a back elevational view, respectively, of a design embodiment of a cowling showing fillets on the edges where the top and bottom meet the side. In one embodiment the radius of the edge is in the range of 0.25 to 0.75 inches and preferably 0.5 inches.

The cutout on the bottom can be an inset that sits on top of and attaches to the wheel spine. As shown it is only a cutout of the shape of the wheel spine. In another variation, the bottom surface is formed without the cutout and the top of the wheel spine sits into the cowling 0.5 inches, having its footprint indented inward into the cowling.

The cowling can be fabricated in two pieces so as to allow the wheels to be installed and removed and so as to allow, potentially, the top surface to be branded or ornamented differently from unit to unit without affecting the rest of the cowling. One piece will be the top surface, the second piece will be the sides and bottom. But this will not affect the look of the piece, only its construction.

The ball chute framework and the cowling may be integrated into a single component. This will affect neither the external appearance in an assembled unit nor the geometry of the ball chute other than the extension that bolts to the wheel spine.

FIGS. 37-42 are isometric view, top plan view, bottom plan view, left side view, front elevational view (the back elevational view being substantially a mirror image thereof), and right side view, respectively, of a design embodiment of a platform formed in accordance with the present disclosure.

The invention claimed is:

1. A training system, comprising:

a ball delivery system that includes:

a ball delivery device capable of delivering a ball at a selected one of a variety of ball trajectories;

an assembly capable of storing a plurality of balls and automatically feeding stored balls to the ball delivery device; and an electronic control system configured to control the ball delivery device with at least one training program operable in the electronic control system; and an assessment program operable in the electronic control system that takes as input a training curriculum, tests player ability to execute training skills of the training curriculum, and produces as outputs an internal rank for the player tested and an individualized curricular training set for the player tested; and an individualized training program for the tested player, operable in the electronic control system and based on the individualized curricular training set for that player.

2. The system of claim 1, wherein the assembly is structured to adjust the accelerator in an order of adjustment that is structured to maintain a same line of flight provided by non-adjusted settings of the axes.

3. The system of claim 1, wherein the assembly is structured to adjust the accelerator in an order of adjustment that is structured to maintain a same line of flight provided by non-adjusted settings of the axes.

4. The system of claim 1 wherein the training curriculum includes a subset identified as marker skills and the assessment program is configured to assess proficiency and training needs by testing a user first against marker training skills to determine a presumptive internal rank associated with the user's marker training skills, and second testing the user for all skills at the presumptive internal rank, and if any deficiencies are noted, testing of the user at a next lower training level, and repeat the testing at a further lower training level until no deficiencies are noted.

5. The system of claim 1, wherein the assessment program is configured to test an ability of the user to move from one skill to another.

6. A system, comprising:

an accelerator configured to serve a ball to a user with a ball trajectory that includes a value for each of an exit speed of the ball from the accelerator, a rate and an axis of spin imparted to the ball upon exit from the accelerator, and an initial direction of flight of the ball on exit from the accelerator; and an electronic control system coupled to the accelerator configured to store and execute a training program that includes a plurality of selectable ball trajectories and a plurality of ball service specifications, each ball service specification including a ball trajectory selectable from the plurality of ball trajectories provided by the training program and at least one from among a starting position of the user relative to the device, an identification of at least one location on the user's body to touch the ball, a time interval to wait before service of the ball, and an action for the user to take with the ball.

7. The system of claim 6, further comprising means to automatically measure a force with which the ball strikes a target after exiting the accelerator.

* * * * *